US009377718B2

(12) United States Patent
Kuramashi et al.

(10) Patent No.: US 9,377,718 B2
(45) Date of Patent: Jun. 28, 2016

(54) IMAGE FORMING APPARATUS AND DEVELOPER SUPPLY METHOD

(71) Applicant: KYOCERA Document Solutions Inc., Osaka-shi, Osaka (JP)

(72) Inventors: Koji Kuramashi, Osaka (JP); Akifumi Yamaguchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/894,305

(22) PCT Filed: Apr. 1, 2015

(86) PCT No.: PCT/JP2015/060351

§ 371 (c)(1),
(2) Date: Nov. 25, 2015

(87) PCT Pub. No.: WO2015/174159

PCT Pub. Date: Nov. 19, 2015

(65) Prior Publication Data

US 2016/0131996 A1 May 12, 2016

(30) Foreign Application Priority Data

May 15, 2014 (JP) ..... 2014-101397
May 15, 2014 (JP) ..... 2014-101398

(51) Int. Cl.
*G03G 15/08* (2006.01)

(52) U.S. Cl.
CPC ..... *G03G 15/0887* (2013.01)

(58) Field of Classification Search
CPC ..... G03G 15/0887; G03G 15/0889
USPC ..... 399/27, 119, 167, 255, 256, 258, 281
See application file for complete search history.

(56) References Cited

U.S. PATENT DOCUMENTS

| | | | | |
|---|---|---|---|---|
| 7,761,037 | B2 * | 7/2010 | Ohashi | G03G 15/0862 399/236 |
| 8,090,276 | B2 * | 1/2012 | Kasai | G03G 15/0868 399/254 |
| 2011/0194863 | A1 | 8/2011 | Matsumoto et al. | |

FOREIGN PATENT DOCUMENTS

| | | | |
|---|---|---|---|
| JP | H11038740 | A | 2/1999 |
| JP | 2000267441 | A | 9/2000 |
| JP | 2004341220 | A | 12/2004 |
| JP | 2009116248 | A | 5/2009 |
| JP | 2009116249 | A | 5/2009 |
| JP | 2011164362 | A | 8/2011 |

* cited by examiner

*Primary Examiner* — Hoang Ngo
(74) *Attorney, Agent, or Firm* — Alleman Hall McCoy Russell & Tuttle LLP

(57) ABSTRACT

An image forming apparatus of the present invention includes a developing device. In a case body of the developing device, a first storage chamber and a second storage chamber are formed. A first agitating screw is provided in the first storage chamber and a second agitating screw is provided in the second storage chamber. A developing roller is provided in the second storage chamber. A control portion controls driving of a first motor and a second motor. When toner installation is performed, the control portion controls driving of the first motor at a rotational speed higher than a rotational speed for development operation in a state where the second motor is stopped. When a certain condition is satisfied, the control portion starts control of driving of the second motor, to drive rotation of the second motor.

13 Claims, 11 Drawing Sheets

FIG. 8

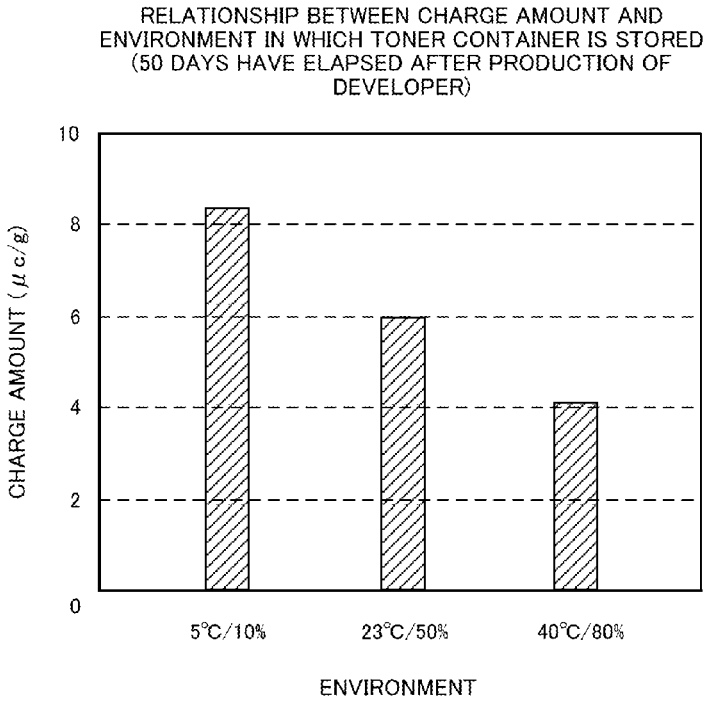

FIG. 9

| | FIRST MOTOR | SECOND MOTOR | STATE OF DEVELOPER | | INSTALLATION TIME (MINUTES) | VARIATION IN LAYER THICKNESS |
|---|---|---|---|---|---|---|
| | | | NUMBER OF DAYS THAT HAVE ELAPSED AFTER PRODUCTION | TEMPERATURE/ HUMIDITY | | |
| COMPARATIVE EXAMPLE 1 | V3 | V1 | 50 | 5°C/10% | 15 MINUTES | PRESENT |
| COMPARATIVE EXAMPLE 2 | V3 | V1 | 0 | 23°C/50% | 15 MINUTES | PRESENT |
| COMPARATIVE EXAMPLE 3 | V3 | V1 | 0 | 5°C/10% | 15 MINUTES | PRESENT |
| COMPARATIVE EXAMPLE 4 | V4 (QUADRUPLE OF V3) | QUADRUPLE OF V1 | 50 | 23°C/50% | 4 MINUTES | PRESENT |
| EXAMPLE 1 | V4 (QUADRUPLE OF V3) | V2 (HALF OF V1) | 50 | 5°C/10% | 4 MINUTES | ABSENT |
| EXAMPLE 2 | V4 (QUADRUPLE OF V3) | V2 (HALF OF V1) | 0 | 23°C/50% | 4 MINUTES | ABSENT |
| EXAMPLE 3 | V4 (QUADRUPLE OF V3) | V2 (HALF OF V1) | 0 | 5°C/10% | 4 MINUTES | ABSENT |
| EXAMPLE 4 | V4 (QUADRUPLE OF V3) | V2 (HALF OF V1) | 50 | 23°C/50% | 4 MINUTES | ABSENT |

FIG. 12A

| | COMPARATIVE EXAMPLE 1 | EXAMPLE 1 |
|---|---|---|
| GAP OF REGULATION BLADE (mm) | LOW SPEED DRIVING CONTROL IS NOT PERFORMED | LOW SPEED DRIVING CONTROL IS PERFORMED (SPEED REDUCTION RATE OF 50%) |
| 0.25 | Poor | Good |
| 0.30 | Poor | Good |
| 0.35 | Poor | Good |
| 0.40 | Poor | Poor |
| 0.45 | Poor | Poor |
| 0.50 | Poor | Poor |

FIG. 12B

| | EXAMPLE 2 | EXAMPLE 3 | EXAMPLE 4 |
|---|---|---|---|
| TONER PRODUCTION TIME | IMMEDIATELY AFTER PRODUCTION | THREE MONTHS HAVE ELAPSED AFTER PRODUCTION | |
| GAP OF REGULATION BLADE (mm) | LOW SPEED DRIVING CONTROL IS PERFORMED (SPEED REDUCTION RATE OF 50%) | LOW SPEED DRIVING CONTROL IS PERFORMED (SPEED REDUCTION RATE OF 50%) | LOW SPEED DRIVING CONTROL IS PERFORMED (SPEED REDUCTION RATE OF 40%) |
| 0.25 | Good | Good | Good |
| 0.30 | Good | Good | Good |
| 0.35 | Good | Good | Good |
| 0.40 | Poor | Good | Good |
| 0.45 | Poor | Good | Good |
| 0.50 | Poor | Poor | Poor |

IMAGE FORMING APPARATUS AND DEVELOPER SUPPLY METHOD

TECHNICAL FIELD

The present invention relates to image forming apparatuses having developing devices, and to a developer supply method for supplying developer into the developing devices.

BACKGROUND ART

Developing devices are mounted to image forming apparatuses, such as copying machines and printers, which form images on paper sheets by electrophotography. In the developing device, a storage chamber in which developer such as toner is stored is provided. In the storage chamber, for example, a developing roller, and a conveying member that conveys the developer to the developing roller are provided. The developing roller and the conveying member are driven by driving force from a motor or the like. In a case where the developer is stored in the storage chamber, the conveying member conveys the developer toward the developing roller, and the developing roller contacts with the conveyed developer and rotates, to hold the developer on the surface thereof.

In recent years, the image forming apparatus is shipped in a state where the storage chamber is vacant without storing developer in the storage chamber of the developing device. Therefore, a user needs to mount, to the image forming apparatus, a developer container, for initial supply, having developer stored therein, so as to supply the developer from the container into the storage chamber when the user uses the image forming apparatus for the first time. In general, the developer container is called a toner container or a toner cartridge. Further, a supply operation for supplying developer at the start of use is called toner installation or setup. Hereinafter, the supply operation is referred to as toner installation.

The toner installation is performed until a state where a toner image can be developed by the developing device is reached. Specifically, the toner installation is performed until a developer layer is formed over the entire region of the surface of the developing roller. In this case, the conveying member is driven until the developer is spread over the entire region of the surface of the developing roller, and the developing roller is also driven until the developer layer is formed on the surface thereof. In conventional image forming apparatuses, in order to shorten a time (installation time) required from start of supply of the developer in the toner installation to completion of the toner installation, a motor is rotated at a higher rotational speed than usual to drive the conveying member at a double speed, when the developer is supplied (see Patent Literature 1).

CITATION LIST

Patent Literature

[PTL 1] Japanese Laid-Open Patent Publication No. 2000-267441

SUMMARY OF THE INVENTION

Problems to be Solved by the Invention

However, in a case where the developing roller is rotated while the developer is being conveyed in the toner installation, a friction is excessively generated between the developing roller and the developer, and the developer may be excessively charged in some cases. For example, in a case where the developer having reached one end of the developing roller earliest, is conveyed toward the other end, before the developer reaches the other end, the developer contacts with a new roller surface (unused surface) which has never contacted with the developer. The roller surface which has never contacted with developer has a higher frictional resistance as compared to the roller surface that has contacted with developer. Therefore, while developer is conveyed along the axial direction of the developing roller, a portion of the developer located at the head in the conveying direction constantly contacts with a new roller surface, and the portion of the developer is excessively charged. On the other hand, to a roller surface of the developing roller with which developer has contacted, for example, an additive such as titanium oxide contained in the developer is attached, to reduce frictional resistance. Therefore, a charge amount of the subsequent portion of the developer does not become excessive. Thus, when the developing roller is rotated in the toner installation, a charge amount of a developer layer held by the developing roller varies in the axial direction. The variation in the charge amount may cause the thickness of the developer layer held by the developing roller to become non-uniform. That is, the thickness of the developer layer held by the developing roller varies. The variation in the layer thickness (non-uniformity in layer) may cause generation of a dotted pattern or a striped pattern on an image on a paper sheet having the image formed thereon, thereby degrading image quality.

An object of the present invention is to provide an image forming apparatus and a developer supply method which shorten, when developer is supplied, for the first time, from a developer container for initial supply, an installation time necessary for the supply, and which reduce variation (non-uniformity in layer) in thickness of a developer layer on a developing roller having been supplied with the developer, to enable degradation of image quality to be prevented.

Solution to the Problems

An image forming apparatus according to one aspect of the present invention includes a developing device, a supply portion, a developing roller, a conveying member, a first driving portion, a second driving portion, and a driving control portion. The developing device has a storage chamber in which developer is stored. The supply portion is provided in the developing device, and is configured to guide, into the storage chamber, the developer supplied from outside. The developing roller is provided in the storage chamber so as to be rotatable, and is configured to contact with the developer stored in the storage chamber to hold the developer on an outer circumferential surface by the developing roller being driven to rotate. The conveying member is provided in the storage chamber so as to be rotatable, and is configured to convey the developer supplied from the supply portion, from one end, in an axial direction, of the developing roller to the other end by the conveying member being driven to rotate. The first driving portion is configured to drive the developing roller so as to rotate. The second driving portion is configured to drive the conveying member so as to rotate. The driving control portion is configured to control driving of the first driving portion in a state where the second driving portion is stopped until the developer is conveyed to the other end by the conveying member, in a case where the developer is supplied from the supply portion into the storage chamber that is vacant, and to start control of driving of the second driving portion on the condition that the developer has been conveyed to the other end.

An image forming apparatus according to another aspect of the present invention includes a developing device, a supply portion, a developing roller, a conveying member, a first determination portion, a driving portion, and a driving control portion. The developing device has a storage chamber in which developer is stored. The supply portion is provided in the developing device, and is configured to guide, into the storage chamber, the developer supplied from outside. The developing roller is provided in the storage chamber so as to be rotatable, and is configured to contact with the developer stored in the storage chamber to hold the developer on an outer circumferential surface by the developing roller being driven to rotate. The conveying member is provided in the storage chamber so as to be rotatable, and is configured to convey the developer supplied from the supply portion, toward the developing roller, by the conveying member being driven to rotate. The first determination portion is configured to determine that the developer conveyed by the conveying member has reached the developing roller. The driving portion is configured to drive at least the developing roller so as to rotate. The driving control portion is configured to control driving of the driving portion such that the developing roller rotates at a predetermined fifth rotational speed in a case where the developer is supplied from the supply portion into the storage chamber that is vacant. Further, the driving control portion is configured to control driving of the driving portion such that the developing roller rotates at a sixth rotational speed lower than the fifth rotational speed on the condition that the first determination portion determines that the developer has reached the developing roller.

A developer supply method according to another aspect of the present invention is a developer supply method for supplying developer into a storage chamber in a state where the storage chamber is vacant without storing the developer, and the developer supply method is performed by an image forming apparatus that includes: a developing device having the storage chamber in which the developer is stored; a supply portion, provided in the developing device, configured to guide, into the storage chamber, the developer supplied from outside; a developing roller, provided in the storage chamber so as to be rotatable, configured to contact with the developer stored in the storage chamber to hold the developer on an outer circumferential surface by the developing roller being driven to rotate; and a conveying member, provided in the storage chamber so as to be rotatable, configured to convey the developer supplied from the supply portion, from one end, in an axial direction, of the developing roller to the other end by the conveying member being driven to rotate. The developer supply method includes a first step and a second step. In the first step, the conveying member is driven so as to rotate, and the conveying member is caused to convey the developer to the other end in a state where rotation of the developing roller is stopped. In the second step, driving of rotation of the developing roller is started on the condition that the developer has been conveyed to the other end.

A developer supply method according to another aspect of the present invention is a developer supply method for supplying developer into a storage chamber in a state where the storage chamber is vacant without storing the developer, and the developer supply method is performed by an image forming apparatus that includes: a developing device having the storage chamber in which the developer is stored; a supply portion, provided in the developing device, configured to guide, into the storage chamber, the developer supplied from outside; a developing roller, provided in the storage chamber so as to be rotatable, configured to contact with the developer stored in the storage chamber to hold the developer on an outer circumferential surface by the developing roller being driven to rotate; a conveying member, provided in the storage chamber so as to be rotatable, configured to convey the developer supplied from the supply portion, toward the developing roller, by the conveying member being driven to rotate; and a driving portion configured to drive at least the developing roller so as to rotate. The developer supply method includes an eleventh step, a twelfth step, and a thirteenth step. In the eleventh step, driving of the driving portion is controlled such that the developing roller rotates at a predetermined fifth rotational speed when the developer is supplied from the supply portion. In the twelfth step, it is determined that the developer conveyed by the conveying member has reached the developing roller. In the thirteenth step, driving of the driving portion is controlled such that the developing roller rotates at a sixth rotational speed lower than the fifth rotational speed on the condition that the developer is determined in the twelfth step as having reached the developing roller.

Advantageous Effects of the Invention

According to the present invention, when developer is supplied, for the first time, from a developer container for initial supply, an installation time necessary for the supply can be shortened, and variation (non-uniformity in layer) in thickness of a developer layer on a developing roller having been supplied with the developer is reduced, to enable degradation of image quality to be prevented.

BRIEF DESCRIPTION OF THE DRAWINGS

FIG. 8 is a graph showing a relationship between an environment in which a toner container is stored and a charge amount of developer.

FIG. 9 shows a table indicative of evaluation of the image forming apparatus, for each condition, for non-uniformity in layer according to Comparative examples 1 to 4, and Examples 1 to 4 of the present invention.

FIG. 12A shows a table indicative of evaluation of the image forming apparatus, for each condition, for non-uniformity in layer according to Comparative example 5, and Example 5 of the present invention.

FIG. 12B shows a table indicative of evaluation of the image forming apparatus, for each condition, for non-uniformity in layer according to Examples 6 to 8 of the present invention.

DESCRIPTION OF EMBODIMENTS

Hereinafter, embodiments of the present invention will be described with reference to the accompanying drawings. For the convenience of description, in each embodiment, the vertical direction is defined as an up-down direction 7 in a state where an image forming apparatus 10 is installed so as to be usable (a state shown in FIG. 1), a front-rear direction 6 is defined based on the surface shown in FIG. 1 representing the front surface of the image forming apparatus 10, and a left-right direction 9 is defined based on the front surface of the image forming apparatus 10.

First Embodiment

Firstly, a first embodiment of the present invention will be described.

Figure 1:
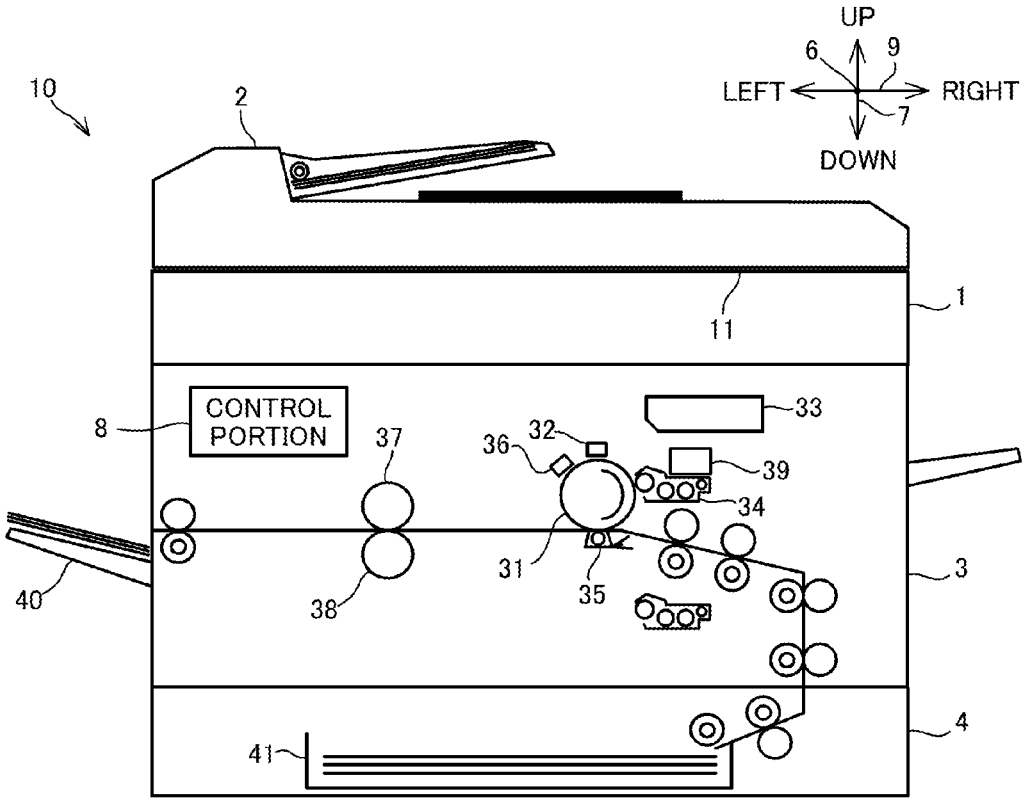
FIG. 1 illustrates a structure of an image forming apparatus according to embodiments of the present invention.

FIG. 1 shows the image forming apparatus 10 according to the first embodiment of the present invention. As shown in FIG. 1, the image forming apparatus 10 includes an image reading portion 1, an image forming portion 3, a sheet feed portion 4, a control portion 8, a first motor 86 (see FIG. 4), a second motor 87 (see FIG. 4), and the like. The control portion 8 represents an example of a driving control portion of the present invention. The first motor 86 represents an example of a first driving portion of the present invention. The second motor 87 represents an example of a second driving portion of the present invention. The image forming apparatus 10 is merely an example of the image forming apparatus of the present invention, and the image forming apparatus of the present invention may be a printer, a facsimile apparatus, a copying machine, or a multifunction peripheral having functions thereof.

The image reading portion 1 includes an ADF (Automatic Document Feeder) 2. The image reading portion 1 reads an image of a document having been set on the ADF 2 or a contact glass 11 to obtain image data. The image reading portion 1 includes, for example, an imaging device such as a CCD (Charge Coupled Device) or a CIS (Contact Image Sensor), an optical lens, a light source, and the like. In the image reading portion 1, light is applied to a document by the light source, reflected by the document, and inputted through the optical lens into the imaging device, whereby image data on the document is read. Detailed description of the image reading portion 1 is omitted.

The sheet feed portion 4 feeds paper sheets on which images are to be formed by the image forming portion 3. The sheet feed portion 4 includes a sheet feed cassette 41, and takes and feeds, one by one, a plurality of paper sheets stored in the sheet feed cassette 41 to the image forming portion 3.

The image forming portion 3 performs an image forming process (printing process) based on the image data read by the image reading portion 1 or image data inputted from an external information processing apparatus such as a personal computer. The image forming portion 3 performs the image forming process by well-known electrophotography. The image forming portion 3 includes a photosensitive drum 31, a charging device 32, an LSU (Laser Scanning Unit) 33, a developing device 34 (an example of a developing device of the present invention), a transfer roller 35, an electricity removing device 36, a fixing roller 37, a pressure roller 38, a toner container 39, and the like. The toner container 39 is detachably mounted to the image forming portion 3. When the image forming apparatus 10 is shipped, the toner container 39 is left detached from the image forming portion 3, and the toner container 39 is separately stored.

Figure 4:
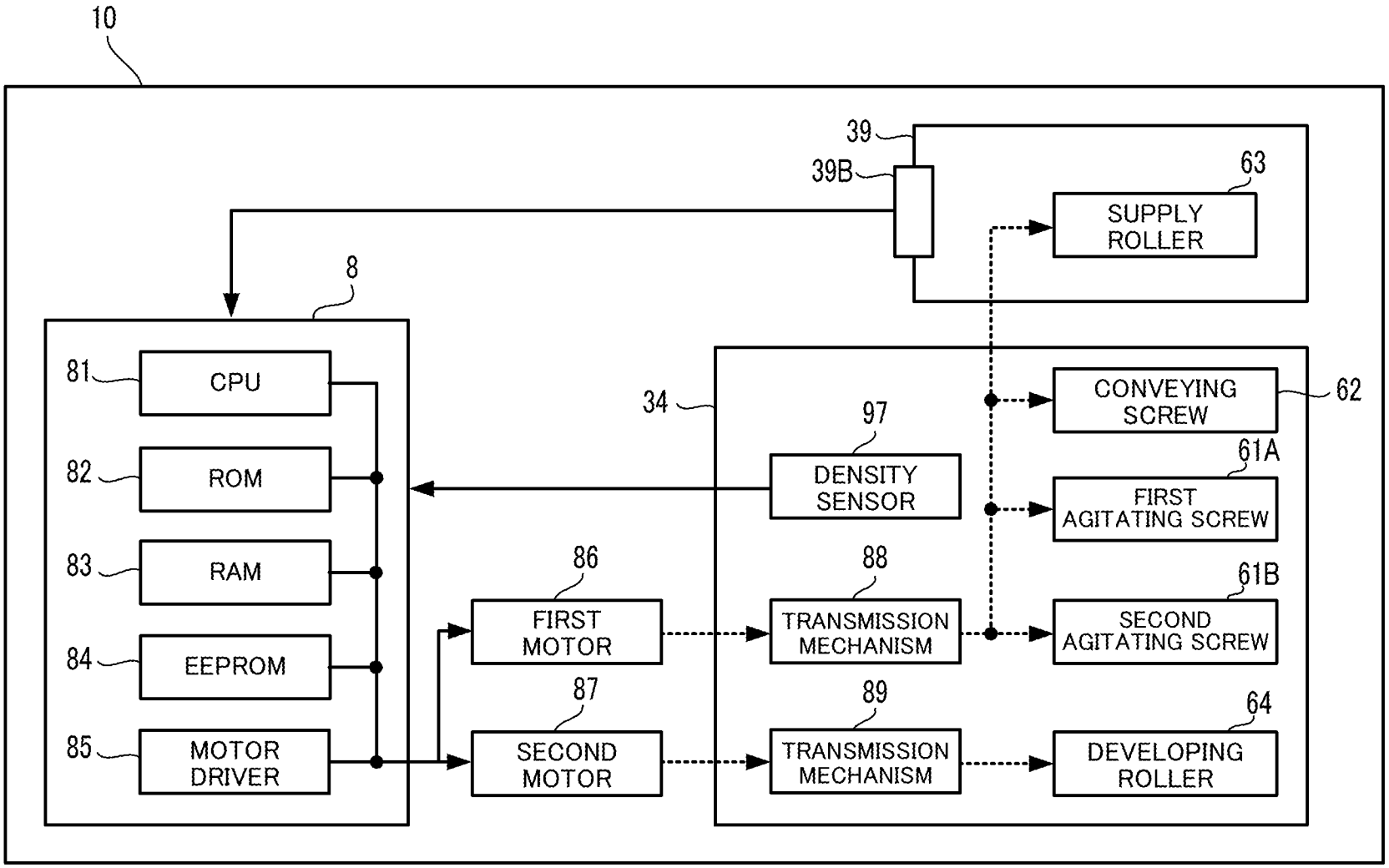
FIG. 4 is a block diagram illustrating a configuration of the image forming apparatus.

The first motor 86 is a driving source such as a stepping motor for outputting rotation driving force. As shown in FIG. 4, the first motor 86 is connected, via a transmission mechanism 88 such as a gear, to a conveying screw 62, a first agitating screw 61A, and a second agitating screw 61B of the developing device 34. Further, the first motor 86 is connected to a supply screw 63 of the toner container 39 via the transmission mechanism 88. Thus, the first motor 86 transmits rotation driving force to the conveying screw 62, the first agitating screw 61A, the second agitating screw 61B, and the supply screw 63 to drive rotation of each component.

The second motor 87 is a driving source such as a stepping motor for outputting rotation driving force. As shown in FIG. 4, the second motor 87 is connected to a developing roller 64 of the developing device 34 via a transmission mechanism 89 such as a gear. Thus, the second motor 87 transmits rotation driving force to the developing roller 64, to drive rotation of the developing roller 64. In the present embodiment, an exemplary case where a drive mechanism such as the conveying screw 62, and the developing roller 64 are driven to rotate by separate motors, respectively, will be described. However, the drive mechanism and the developing roller 64 may be driven to rotate, by a single motor, in conjunction with each other.

Driving of each of the first motor 86 and the second motor 87 is controlled by a motor driver 85 described below. Thus, the first agitating screw 61A, the second agitating screw 61B, the developing roller 64, and the like are driven to rotate in one predefined direction.

In the image forming portion 3, an image is formed on a paper sheet fed by the sheet feed portion 4 in the following procedure. Firstly, the photosensitive drum 31 is uniformly charged at a predetermined potential by the charging device 32. Next, light based on the image data is applied to the surface of the photosensitive drum 31 by the LSU 33. Thus, an electrostatic latent image is formed on the surface of the photosensitive drum 31. The electrostatic latent image on the photosensitive drum 31 is developed (visualized) as a toner image by the developing device 34. Subsequently, the toner image formed on the photosensitive drum 31 is transferred onto the paper sheet by the transfer roller 35. Thereafter, the toner image having been transferred onto the paper sheet is heated, and fused and fixed onto the paper sheet by the fixing roller 37 while the paper sheet passes between the fixing roller 37 and the pressure roller 38 and is discharged. Potential of the photosensitive drum 31 is removed by the electricity removing device 36. The paper sheet having the image thus formed thereon is then discharged onto a sheet discharge tray 40.

Figure 2:
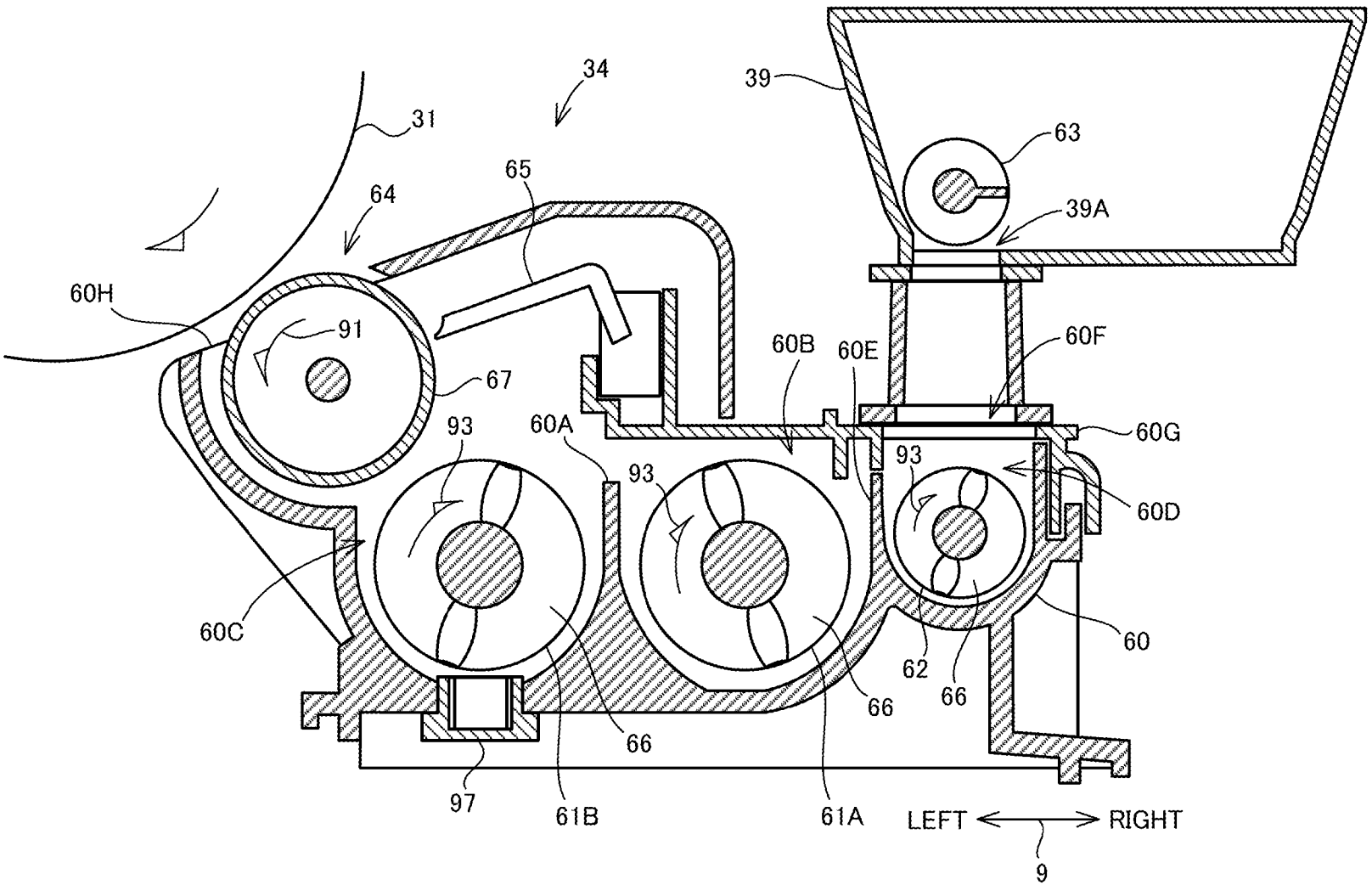
FIG. 2 illustrates a configuration of a cross-section of a developing device.
Figure 3:
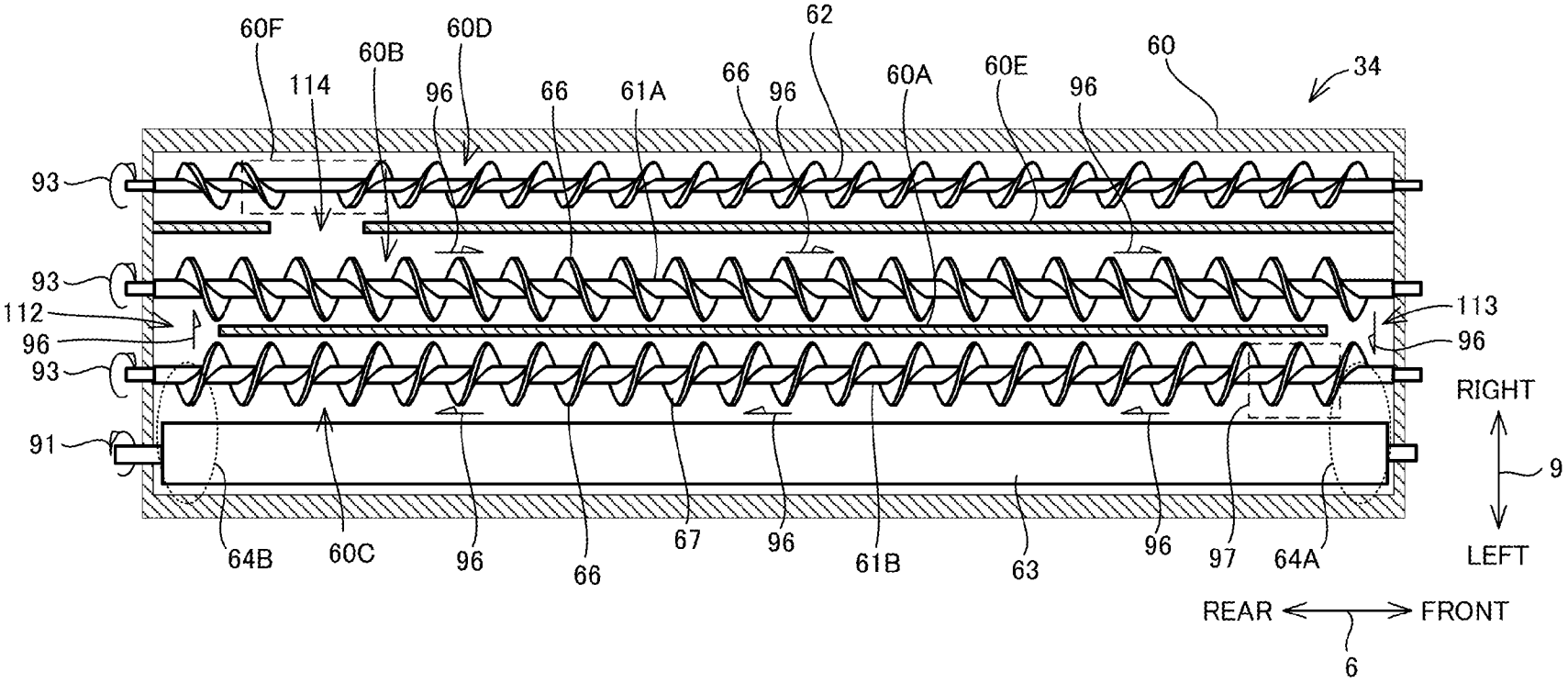
FIG. 3 illustrates positioning of components in the developing device.

Next, with reference to FIG. 2 and FIG. 3, a configuration of the developing device 34 will be described. FIG. 2 is a cross-sectional view of a configuration of the developing device 34 of the image forming portion 3. FIG. 3 illustrates an internal state of the developing device 34.

By the developing device 34, the electrostatic latent image on the photosensitive drum 31 is developed with the use of developer containing toner particles. As shown in FIG. 2, the developing device 34 includes a case body 60 having developer stored therein. The developer stored in the case body 60 is one-component developer having magnetic toner as a main component. The developer has a small amount of titanium oxide, silica (silicon dioxide), or the like mixed therein as an external additive, in addition to the magnetic toner.

The case body 60 not only stores the developer but also serves as a casing of the developing device 34. The case body 60 is formed in a shape elongated in the longitudinal direction (the front-rear direction 6) of the developing device 34. The inside of the case body 60 is divided, by a dividing wall 60A, into a first storage chamber 60B and a second storage chamber 60C. In the first storage chamber 60B and the second storage chamber 60C, the developer is stored. The first storage chamber 60B and the second storage chamber 60C are not completely separated. As shown in FIG. 3, communications paths 112 and 113 through which both chambers communicate with each other are provided at both end portions in the front-rear direction 6.

Further, the case body 60 includes a conveying chamber 60D in which developer supplied from the outside is conveyed to the first storage chamber 60B. A dividing wall 60E is provided between the conveying chamber 60D and the first storage chamber 60B. The conveying chamber 60D and the first storage chamber 60B are divided by the dividing wall 60E. The conveying chamber 60D and the first storage chamber 60B are not completely separated. As shown in FIG. 3, a communication path 114 through which both chambers communicate with each other is provided near an end portion on the rear side of the dividing wall 60E.

A supply inlet 60F (an example of a supply portion of the present invention) is formed in the case body 60. The supply inlet 60F is formed in a wall surface 60G (see FIG. 2) on the upper side of the conveying chamber 60D. The supply inlet 60F is a through hole through which the developer supplied (fed) from the toner container 39 is guided into the first storage chamber 60B via the conveying chamber 60D of the case body 60. The supply inlet 60F is formed near an end portion on the rear side of the wall surface 60G (see a portion enclosed by a broken line in FIG. 3).

In the conveying chamber 60D, the conveying screw 62 is rotatably mounted. The conveying screw 62 is connected to the first motor 86 via the transmission mechanism 88. The conveying screw 62 rotates due to rotation driving force applied thereto from the first motor 86 via the transmission mechanism 88. In the present embodiment, the conveying screw 62 rotates in a rotation direction (a direction indicated by an arrow 93 in FIG. 2 and FIG. 3) defined by the transmission mechanism 88. By rotation of the conveying screw 62, the developer supplied through the supply inlet 60F from the toner container 39 is conveyed through the communication path 114 into the first storage chamber 60B.

In the first storage chamber 60B, the first agitating screw 61A is rotatably mounted. In the second storage chamber 60C, the second agitating screw 61B (an example of a conveying member of the present invention) is rotatably mounted. The first agitating screw 61A and the second agitating screw 61B are connected to the first motor 86 via the transmission mechanism 88. The first agitating screw 61A and the second agitating screw 61B rotate due to rotation driving force applied thereto from the first motor 86 via the transmission mechanism 88 such as a gear. In the present embodiment, the first agitating screw 61A and the second agitating screw 61B rotate in a rotation direction (the direction indicated by the arrow 93 in FIG. 2 and FIG. 3) defined by the transmission mechanism 88.

By rotation of the first agitating screw 61A, the developer supplied through the supply inlet 60F from the toner container 39 and conveyed into the first storage chamber 60B, is conveyed in the axial direction while being agitated. Further, by rotation of the second agitating screw 61B, the developer transferred from the first storage chamber 60B through the communication path 113 into the second storage chamber 60C is conveyed toward the developing roller 64. Specifically, the second agitating screw 61B conveys, while agitating the developer transferred into the second storage chamber 60C, the developer in the axial direction of the developing roller 64 from a front end portion 64A on one side toward a rear end portion 64B on the other side. The developer which has been conveyed to the front end portion 64A is transferred into the first storage chamber 60B through the communication path 112, and is conveyed again by the first agitating screw 61A. Thus, by rotation of the first agitating screw 61A and the second agitating screw 61B, the developer supplied through the supply inlet 60F from the toner container 39 and conveyed into the first storage chamber 60B is conveyed in the axial direction while being agitated. In the present embodiment, the developer is circulated and conveyed, in a direction indicated by an arrow 96 (see FIG. 3), between the first storage chamber 60B and the second storage chamber 60C, through the communications paths 112 and 113 (see FIG. 4) formed in the dividing wall 60A. Further, the developer is agitated by the first agitating screw 61A and the second agitating screw 61B, whereby the magnetic toner of the developer is charged with static electricity due to friction.

As shown in FIG. 3, the first agitating screw 61A, the second agitating screw 61B, and the conveying screw 62 each have a helical blade 66 around its axis. Each of the screws 61A, 61B, and 62 is a so-called screw roller having the blade 66. By the blade 66, while the developer in the case body 60 is agitated, the developer is conveyed in a direction along the axial direction. The helical direction, with respect to the axis, of the blade 66 of the first agitating screw 61A and the helical direction, with respect to the axis, of the blade 66 of the second agitating screw 61B are opposite to each other. Therefore, even when the first agitating screw 61A and the second agitating screw 61B are rotated in the same rotation direction (the direction indicated by the arrow 93), the developer is circulated and conveyed in the direction indicated by the arrow 96 in FIG. 3.

As shown in FIG. 2, a density sensor 97 is mounted on a bottom wall of the second storage chamber 60C. The density sensor 97 measures a density of the developer in the case body 60, specifically, a density of the magnetic toner. In the present embodiment, as shown in FIG. 3, the density sensor 97 is mounted near the end portion on the front side on the bottom wall of the second storage chamber 60C. The density sensor 97 is connected to the control portion 8, and an electric signal (for example, a voltage signal) that is a sensor signal from the density sensor 97 is inputted to the control portion 8. The control portion 8 detects a density of the developer based on the electric signal from the density sensor 97.

As shown in FIG. 2, the toner container 39 is configured to be connectable to the developing device 34. The toner container 39 is a container in which developer is stored, and is also referred to as a toner cartridge or a toner bottle. The toner container 39 is detachably mounted to the image forming portion 3 of the image forming apparatus 10. The toner container 39 is formed in a shape elongated in the front-rear direction 6. In a state where the toner container 39 is mounted to the image forming portion 3, the toner container 39 and the developing device 34 are connected to each other as shown in FIG. 2. In a state where the toner container 39 and the developing device 34 are connected to each other, developer can be supplied through a discharge outlet 39A of the toner container 39 to the supply inlet 60F.

As shown in FIG. 4, the toner container 39 includes a connection portion 39B that electrically connects with the control portion 8. The connection portion 39B includes, for example, a terminal that enables electrical connection, and a memory in which information on the toner container 39 is stored. In the memory, information on a production time when the developer contained in the toner container 39 has been produced, a type of the developer, and the like is stored. When the toner container 39 is mounted to the image forming portion 3, the control portion 8 electrically connects with the connection portion 39B, and thus can determine that the toner container 39 has been mounted, and can also read the information in the memory.

In the toner container 39, the supply screw 63 having a helical blade is mounted. The supply screw 63 is rotatably supported by side walls on both ends in the longitudinal direction (the front-rear direction 6) of the toner container 39. The supply screw 63 is a so-called screw roller, and continuously supplies the developer stored in the toner container 39 from the toner container 39 to the supply inlet 60F. Specifically, the supply screw 63 conveys the developer along the axial direction toward the discharge outlet 39A by means of the helical blade provided around the axis, and supplies the developer so as to drop the developer downward through the discharge outlet 39A toward the supply inlet 60F.

The supply screw 63 is connected to the first motor 86 via the transmission mechanism 88. The supply screw 63 rotates due to rotation driving force applied thereto from the first motor 86 via the transmission mechanism 88. In the present embodiment, the supply screw 63 rotates in a rotation direction defined by the transmission mechanism 88. By rotation of the supply screw 63, the developer stored in the toner container 39 is conveyed toward the discharge outlet 39A.

As shown in FIG. 2, in the case body 60, the developing roller 64 is rotatably mounted. The developing roller 64 is disposed in the second storage chamber 60C so as to be closer to the photosensitive drum 31 than the second agitating screw 61B is. The developing roller 64 is disposed parallel to the second agitating screw 61B. The developing roller 64 has a cylindrical developing sleeve 67. The developing sleeve 67 is rotatably supported in the second storage chamber 60C. The developing roller 64 is configured to contact with the developer stored in the second storage chamber 60C by the developing roller 64 being driven to rotate, and to be able to hold the developer on the outer circumferential surface of the developing sleeve 67 upon the contact.

The developing roller 64 opposes the photosensitive drum 31 on an opening 60H side (the left side in FIG. 2) of the case body 60. That is, the developing roller 64 is disposed so as to oppose the outer circumferential surface of the photosensitive drum 31. The developing roller 64 rotates counterclockwise (a direction indicated by an arrow 91 in FIG. 2) in FIG. 2 due to rotation driving force transmitted from the second motor 87 via the transmission mechanism 89.

In the developing sleeve 67, a magnet (not shown) having a magnetic pole is provided. For example, a regulation pole which allows a peak magnetic force to be generated at a position opposing a regulation blade 65 described below, a developing pole that allows a peak magnetic force to be generated at a position facing the photosensitive drum 31, and a magnetic pole for adsorbing the developer stored in the second storage chamber 60C, are provided. Due to the magnetic poles, and magnetic properties of the developer, the developer is attracted to and held at the surface of the developing sleeve 67. Thus, a thin layer (developer layer) of the developer is formed on the surface of the developing roller 64.

The regulation blade 65 made of metal and having magnetic properties is provided above the developing roller 64. The regulation blade 65 is provided near the developing roller 64. Specifically, the regulation blade 65 is provided upstream of a position at which the developing roller 64 and the photosensitive drum 31 oppose each other, in the rotation direction. The regulation blade 65 regulates the thickness of the developer layer held by the developing roller 64. A predetermined gap (clearance) is formed between the end of the regulation blade 65 and the developing roller 64. The layer thickness of the developer layer that adheres to the developing roller 64 is regulated by the regulation blade 65 so as to become a thickness based on the gap. Specifically, when the developer layer passes by the end portion of the regulation blade 65 by rotation of the developing roller 64, the developer layer is regulated so as to have the thickness that almost corresponds to the gap, and is formed into a thin layer having a uniform thickness. The layer thickness of the developer layer that adheres to the developing roller 64 is regulated by the regulation blade 65. Thus, the developer layer held by the developing roller 64 can have almost a uniform thickness.

The developer layer formed on the developing roller 64 is conveyed to a position where the photosensitive drum 31 and the developing roller 64 oppose each other by rotation of the developing roller 64. A bias voltage with a predetermined potential is applied to both or one of the developing roller 64 and the photosensitive drum 31, and a predetermined difference in potential is generated between the developing roller 64 and the photosensitive drum 31. The developer layer on the developing roller 64 flies from the developing roller 64 due to the difference in potential from the photosensitive drum 31, to reach the electrostatic latent image on the photosensitive drum 31, whereby the electrostatic latent image is developed with the developer.

Next, the function of the control portion 8 will be described with reference to FIG. 4. The control portion 8 comprehensively controls the image forming apparatus 10. As shown in FIG. 4, the control portion 8 includes a CPU 81, a ROM 82, a RAM 83, an EEPROM (registered trademark) 84, the motor driver 85, and the like. The ROM 82 is a non-volatile storage device, the RAM 83 is a volatile storage device, and the EEPROM 84 is a non-volatile storage device. The RAM 83 and the EEPROM 84 are used as temporary storage memories for various processes executed by the CPU 81. The motor driver 85 controls driving of the first motor 86 and the second motor 87 based on a control signal from the CPU 81. In the ROM 82, a predetermined control program is stored. The control portion 8 may be implemented as an electronic circuit such as an integrated circuit (ASIC, DSP). Further, the control portion 8 may be a control portion that is provided separately from a main control portion that comprehensively controls the image forming apparatus 10.

The control portion 8 comprehensively controls the image forming apparatus 10 by the CPU 81 executing the predetermined control program stored in the ROM 82. Specifically, a program (image forming process program) for implementing image formation is stored in the ROM 82. Further, in the ROM 82, a motor control program for controlling driving of the first motor 86 and the second motor 87 during the toner installation in which developer is supplied to the case body 60 that is vacant, is stored.

In a case where the image forming apparatus 10 having the case body 60 that is vacant is shipped, a user needs to perform the toner installation before using the image forming apparatus 10. That is, the user needs to mount, to the image forming apparatus 10, the toner container 39 having the developer stored therein, to supply the developer from the toner container 39 into the case body 60. In the toner installation, after the toner container 39 has been mounted, the supply screw 63 is rotated to supply the developer from the toner container 39 into the case body 60, and the conveying screw 62, the first agitating screw 61A, and the second agitating screw 61B are rotated to convey the supplied developer toward the developing roller 64. The developer is charged with static electricity generated by contact friction against the blade 66 while the developer is being conveyed.

Further, in a case where the developing roller 64 is rotated so as to allow the developing sleeve 67 to hold the developer, the developing roller 64 contacts with the developer, and the developer is charged with static electricity generated due to the contact friction. However, in a case where the developing roller 64 is rotated in order to shorten the installation time in the toner installation, when the developer conveyed in the axial direction of the developing roller 64 has reached the rear end portion 64B, a charge amount of the developer layer formed along the axial direction of the developing roller 64 may vary in some cases. The variation in charge amount causes the thickness of the developer layer held by the developing roller 64 to become non-uniform. That is, the thickness of the developer layer held by the developing roller 64 varies. The layer thickness of the developer layer is physically made uniform by the regulation blade 65. However, after the layer thickness has been made uniform, the layer thickness varies (non-uniformity in layer occurs) due to variation in charge amount. The variation in layer thickness may cause, for example, a dotted pattern or a striped pattern on an image on a paper sheet having the image formed thereon, thereby degrading image quality.

In order to overcome the problem, in the present embodiment, the control portion 8 causes the CPU 81 to execute various calculation processes according to the motor control program, and control of driving of the first motor 86 and the second motor 87 with the use of the motor driver 85. Thus, in the toner installation, the first motor 86 and the second motor 87 are independently driven separately from each other. Specifically, the control portion 8 performs control of driving of the first motor 86 at a rotational speed higher than a rotational speed for developing operation in a state where the second motor 87 is stopped. When a certain condition is satisfied, the control portion 8 starts control of driving of the second motor 87, to drive rotation of the second motor 87.

Figure 5:
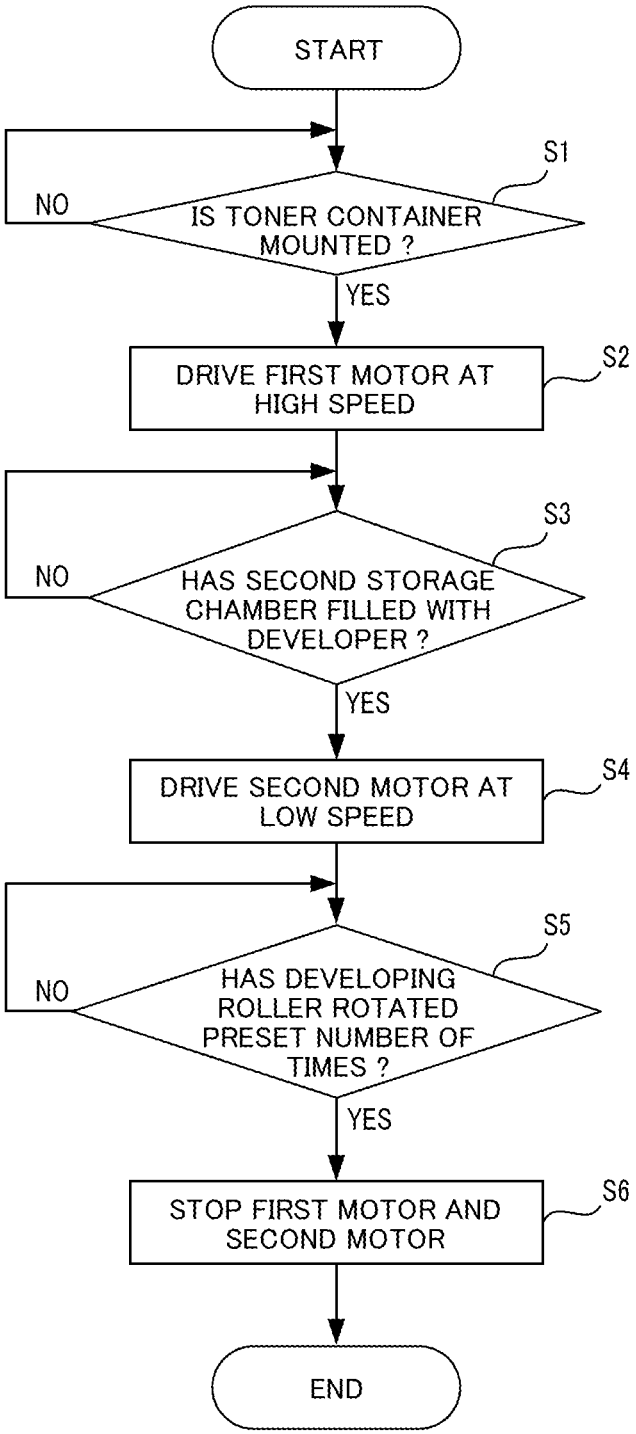
FIG. 5 is a flow chart showing an exemplary procedure of motor control, in toner installation, which is executed by a control portion of the image forming apparatus.

Hereinafter, with reference to a flow chart of FIG. 5, an example of control of driving of the first motor 86 and the second motor 87 in the toner installation, and a procedure of a developer supply method of the present invention which is applied to the image forming apparatus 10, will be described. In FIG. 5, S1, S2, . . . represent the process procedure (step) numbers. In the following description, the toner container 39 for initial supply is mounted to the image forming apparatus 10 having the case body 60 that is vacant, and the toner installation is thereafter performed as an initial preparation operation in the image forming apparatus 10.

When the image forming apparatus 10 is powered on, the control portion 8 determines whether or not the toner container 39 is mounted to the image forming portion 3 (S1). The control portion 8 can determine whether or not the toner container 39 is mounted, based on, for example, an output signal from, for example, a sensor which outputs an ON signal when the toner container 39 is mounted. Alternatively, a user makes an input so as to notify the image forming apparatus 10 that the toner container 39 is mounted, and the control portion 8 can determine whether or not the toner container 39 is mounted, based on the inputted information. Alternatively, the control portion 8 can determine whether or not the toner container 39 is mounted, based on electrical connection with the connection portion 39B (see FIG. 4) being detected when the toner container 39 is mounted.

When the toner container 39 is determined, in step S1, as being mounted, the control portion 8 starts control of driving of the first motor 86 (S2). Specifically, the control portion 8 controls driving of only the first motor 86 without driving the second motor 87. Step S2 of thus controlling driving of the first motor 86 corresponds to a first step in the developer supply method of the present invention. When the process step of step S2 is thus performed, in a state where the developing roller 64 is stopped, the supply screw 63, the conveying screw 62, the first agitating screw 61A, and the second agitating screw 61B are driven to rotate by the first motor 86 in the image forming apparatus 10. Thus, the developer is supplied by the supply screw 63 from the toner container 39 into the conveying chamber 60D. The developer having been supplied into the conveying chamber 60D is conveyed, by the conveying screw 62, through the communication path 114 into the first storage chamber 60B. Further, the developer having been conveyed into the first storage chamber 60B is conveyed in the direction indicated by the arrow 96 by the first agitating screw 61A and the second agitating screw 61B that are driven to rotate.

In the present embodiment, in the driving control in step S2, the control portion 8 drives the first motor 86 to rotate at a rotational speed higher than a rotational speed (hereinafter, referred to as a normal rotational speed) for rotation during development by the developing device 34 in the image forming process. Specifically, the first motor 86 is driven to rotate at a speed that is four times higher than the normal rotational speed. Therefore, the supply screw 63, the conveying screw 62, the first agitating screw 61A, and the second agitating screw 61B are rotated at a rotational speed V4 (an example of a fourth rotational speed of the present invention) that is four times a rotational speed V3 (an example of a third rotational speed of the present invention) for rotation during development. Thus, each of the screws 63, 62, 61A, and 61B is rotated at a quadruple speed, whereby a conveying speed of the supplied developer is increased, and the developer can be conveyed to the developing roller 64 in a short time period. The rotational speed V4 is not limited to the speed that is four times the rotational speed V3, and may be a rotational speed higher than the rotational speed V3.

In the subsequent step S3, the control portion 8 determines whether or not the second storage chamber 60C has been filled with the developer. When the developer is supplied, into the case body 60 that is vacant, for the first time, the developer supplied earliest is gradually conveyed by the first agitating screw 61A and the second agitating screw 61B. When the developer from the front end portion 64A of the developing roller 64 has reached the rear end portion 64B on the other side, the second storage chamber 60C is filled with the developer. In the present embodiment, when a preset time has elapsed since detection of the developer by the density sensor 97, the control portion 8 determines that the second storage chamber 60C has been filled with the developer. The preset time is a time required for the developer to reach the rear end portion 64B since detection of the developer by the density sensor 97. The preset time may be a time based on, for example, an actually measured value. Alternatively, the preset time may be a time calculated according to a speed at which the developer is conveyed by the second agitating screw 61B, and a distance to the rear end portion 64B. That is, in step S3, the control portion 8 determines whether or not the developer having been supplied earliest in the toner installation has been conveyed from the front end portion 64A to reach the rear end portion 64B.

When the second storage chamber 60C is determined, in step S3, as having been filled with the developer, the control portion 8 starts control of driving of the second motor 87 (S4). That is, the control portion 8 controls driving of the second motor 87 that has been stopped, on the condition that the developer from the front end portion 64A has been conveyed to the rear end portion 64B. Control of driving of the second motor 87 is started, whereby the developing roller 64 that has been stopped is rotated. Step S4 of thus staring control of driving of the second motor 87 in a case where the second storage chamber 60C has been filled with the developer, corresponds to a second step in the developer supply method of the present invention. In the present embodiment in which such a process step of step S4 is performed, the developing roller 64 is not rotated before the second storage chamber 60C is filled with the developer, in the toner installation. In a case where the second storage chamber 60C has been filled with the developer, the developing roller 64 is rotated. Thus, since the entire region of the roller surface of the developing roller 64 uniformly contacts with the fully supplied developer, the developer layer is uniformly charged due to contact friction between the developing roller 64 and the developer.

In a state where developer does not adhere to the developing roller 64, contact friction on the surface of the developing roller 64 is increased. Therefore, friction generated due to contact between the developing roller 64 and the developer may cause the developer to be excessively charged in some cases. Therefore, in the image forming apparatus 10, the control portion 8 drives the second motor 87 to rotate at a rotational speed lower than the normal rotational speed. Specifically, the second motor 87 is driven to rotate at half the normal rotational speed. Therefore, the developing roller 64 is rotated at a rotational speed V2 (a second rotational speed) that is half a rotational speed V1 (a first rotational speed) for rotation during development. When the developing roller 64 is thus rotated at the rotational speed V2 that is a half speed, the developer layer is prevented from being excessively charged during the toner installation. The rotational speed V2 is not limited to half the rotational speed V1, and may be a rotational speed lower than the rotational speed V1.

In the subsequent step S5, driving of the second motor 87 is controlled such that the developing roller 64 is rotated at the rotational speed V2 until the number of times the developing roller 64 has rotated reaches a preset number of times. The preset number of times is the number of times based on which the evaluation that a layer of the developer has been formed over the entire region of the developing roller 64 with a uniform thickness, can be made. In the present embodiment, the preset number of times of the rotation is two. Needless to say, the preset number of times of the rotation can be set as any number, and is not limited to two as described above.

When it is determined, in step S5, that the developing roller 64 has rotated the preset number of times, the control portion 8 determines that the toner installation has been completed, and stops driving rotation of the first motor 86 and the second motor 87 (S6).

As described above, in the image forming apparatus 10 according to the first embodiment, during the toner installation, only the first motor 86 is driven to rotate, and when the second storage chamber 60C has been filled with developer, driving of rotation of the second motor 87 is started. Thus, a charge amount of the developer layer held by the developing roller 64 becomes constant over the entire region in the axial direction. That is, a charge amount of the developer layer in the axial direction of the developing roller 64 does not vary. Thus, the layer thickness does not vary, and a dotted pattern, a striped pattern, or the like caused due to variation in layer thickness does not appear on an image on a paper sheet, thereby preventing degradation of image quality.

Further, the developing roller 64 is rotated at the rotational speed V2 that is lower than the rotational speed V1 during the toner installation, whereby the developer layer is prevented from being excessively charged, and degradation of image quality due to variation in layer thickness is prevented.

Moreover, the screws 63, 62, 61A, and 61B are each rotated at the rotational speed V4 that is higher than the rotational speed V3, whereby a conveying speed for the developer having been supplied in the toner installation is increased, and the developer can be conveyed to the developing roller 64 in a short time period.

Second Embodiment

Figure 6:
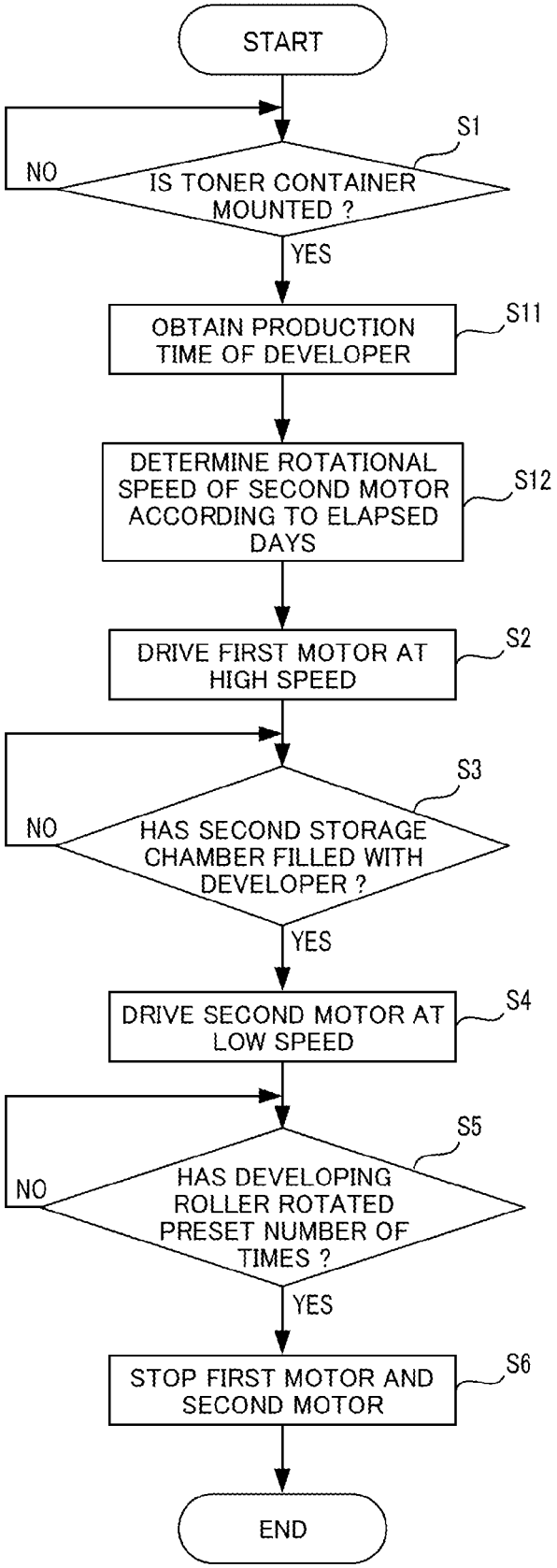
FIG. 6 is a flow chart showing another exemplary procedure of motor control, in the toner installation, which is executed by the control portion of the image forming apparatus.
Figure 7:
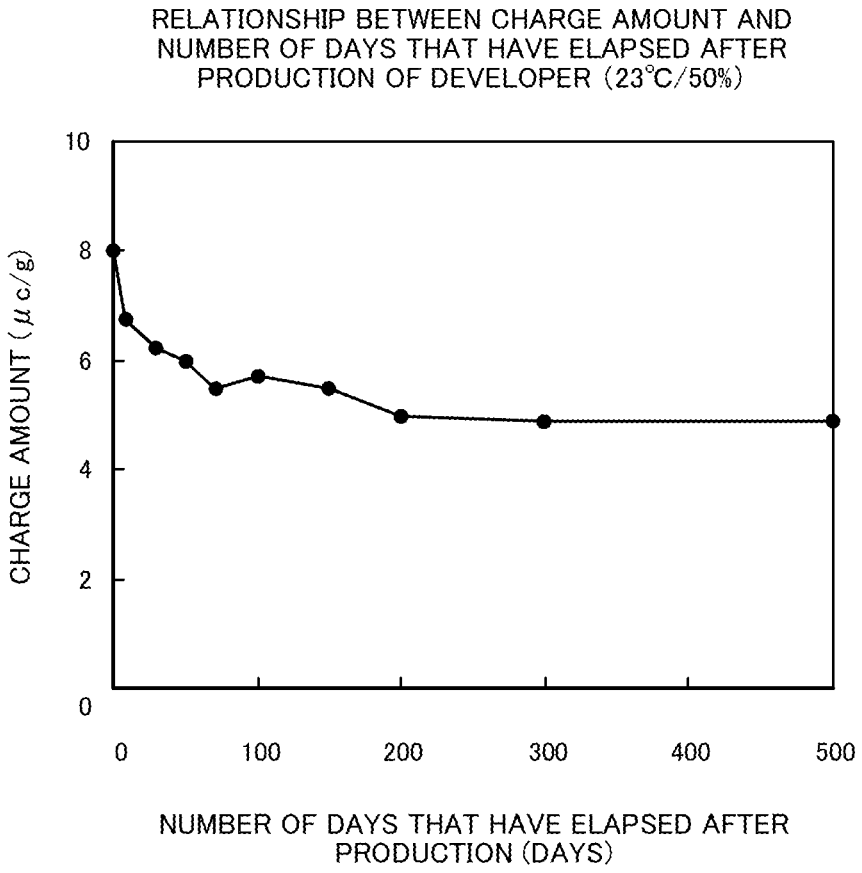
FIG. 7 is a graph showing a relationship between the number of days that have elapsed after production of developer and a charge amount of the developer.

Hereinafter, a second embodiment of the present invention will be described with reference to FIG. 6 to FIG. 8. The same components as described for the first embodiment are denoted by the reference numerals as used in the first embodiment, and the description of the components is not given. The second embodiment is different from the first embodiment in that motor control by the control portion 8 includes new process steps of step S11 and step S12 in FIG. 6 in the second embodiment.

Another example of control of driving of the first motor 86 and the second motor 87 during the toner installation will be described below with reference to a flow chart of FIG. 6. Also in the below description, the toner container 39 for initial supply is mounted to the image forming apparatus 10 having the case body 60 that is vacant, and the toner installation is thereafter performed as an initial preparation operation in the image forming apparatus 10.

When the toner container 39 is determined, in step S1, as being mounted (Yes in S1), the control portion 8 obtains information representing a production time of developer to be supplied from the toner container 39 (S11). The control portion 8 that obtains the information representing the production time is an example of an obtaining portion of the present invention. For example, the control portion 8 allows a user to input, to the image forming apparatus 10, a production time of the developer stored in the toner container 39, whereby the control portion 8 can determine the production time based on the inputted information. Alternatively, the control portion 8 reads the production time from the memory of the connection portion 39B by electrical connection with the connection portion 39B (see FIG. 4) when the toner container 39 is mounted, thereby determining the production time.

In the subsequent step S12, the control portion 8 obtains an elapsed time after production based on the production time having been obtained in step S11, and determines a rotational speed of the second motor 87 for the toner installation according to the elapsed time. The determined rotational speed is set in a register of the CPU 81, the EEPROM 84, or the like of the control portion 8. The rotational speed determined in step S12 is less than the normal rotational speed.

A relationship between the number of days that have elapsed after production of developer and a charge amount of the developer will be described. In general, in the final production process step for developer, the developer is sufficiently agitated by an agitator. Therefore, immediately after the developer has been produced, the developer is highly charged with static electricity due to friction during agitation. That is, the developer is excessively charged immediately after the production of the developer. On the other hand, in a case where the number of days that have elapsed after the production is increased, a charge amount of the developer is gradually reduced, and eventually stabilized at a constant charge amount. Specifically, developer having a charge amount of 8.0 μc/g immediately after the production was stored in the toner container 39 and left for 500 days as it was in an environment where the temperature was 23° C. and the humidity was 50%, and the charge amount of the stored developer was observed during the days. As a result, as shown in FIG. 7, as the number of days that have elapsed is increased, the charge amount is gradually reduced, and stabilized at almost 5.0 μc/g when about six months (180 days) have elapsed. Thus, the charge amount of the developer layer held by the developing roller 64 is different between: the toner installation using the toner container 39 that contains developer having been just produced; and the toner installation using the toner container 39 that contains developer having been produced certain days before. Further, even if the developing roller 64 is rotated at the rotational speed V2 in the toner installation to reduce the charge amount, difference in days that have elapsed after production of the toner container 39 causes difference in a charge amount of the developer layer in each toner installation. In particular, in a case where the toner container 39 that contains developer having been just produced is used in the toner installation, even if the developing roller 64 is rotated at the rotational speed V2, a charge amount of the developer layer on the developing roller 64 becomes excessive, whereby image quality may be degraded.

Therefore, in step S12, the control portion 8 determines a rotational speed of the developing roller 64 such that the less the number of days that have elapsed after production of the developer is, the lower the rotational speed of the developing roller 64 in the toner installation is. Further, the control portion determines a rotational speed of the developing roller 64 such that the greater the number of days that have elapsed is, the higher the rotational speed of the developing roller 64 in the toner installation is. Specifically, a lookup table representing a relationship between the number of days that have elapsed, and the corresponding rotational speed, is stored in the EEPROM 84 of the control portion 8. The control portion 8 obtains the number of days that have elapsed after production of the toner container 39 to be used in the toner installation, and reads, from the lookup table, a rotational speed corresponding to the number of days that have elapsed, and sets the read rotational speed as the rotational speed of the second motor 87. After the charge amount of the developer has been stabilized, the control portion 8 sets a rotational speed corresponding to the stabilized charge amount as the rotational speed of the second motor 87, regardless of the number of days that have elapsed.

When the rotational speed of the second motor 87 is determined in step S12, the first motor 86 is driven to rotate at the rotational speed V1 that is the quadruple speed (S2), and, when the second storage chamber 60C has been thereafter filled with the developer (S3), the second motor 87 is driven to rotate at the rotational speed having been determined in step S12 (S4).

As described above, in the second embodiment, the rotational speed of the second motor 87 in the toner installation is determined according to the number of days that have elapsed after production of the developer, and the second motor 87 is driven to rotate at the rotational speed. Therefore, the charge amount of the developer layer becomes constant, and the layer thickness of the developer layer on the developing roller 64 after the toner installation constantly becomes uniform, regardless of a production time of the developer.

The charge amount is also influenced by an environment (temperature and humidity) in which the toner container 39 containing the developer is stored. Specifically, in each of environments having different temperatures and humidities, the toner container 39 was stored for 50 days after production of the developer, and the charge amount of the stored developer was thereafter observed. As a result, as shown in FIG. 8, it has been found that the lower the temperature and humidity are, the less reduction of the charge amount of the developer is, while the higher the temperature and humidity are, the greater reduction of the charge amount of the developer is. When the environmental temperature is high, an external additive is likely to be embedded in toner particles, and it is assumed that, for this reason, the charge amount of the developer is reduced. Therefore, in a case where the toner container 39 to be used in the toner installation, has been stored in an environment where the temperature and humidity are low, the second motor 87 may be driven to rotate at the rotational speed V2 that is low, in step S4. In a case where the toner container 39 has been stored in an environment where the temperature and humidity are high, since excessive charging does not occur, the second motor 87 may be driven to rotate at a normal rotational speed, without driving the second motor 87 to rotate at a low rotational speed in step S4, for shortening the installation time.

Evaluation of Examples 1 to 4

Hereinafter, evaluation for variation (non-uniformity in layer) in layer thickness of the developer layer held by the developing roller 64 during the toner installation, will be described with reference to FIG. 9. FIG. 9 shows a table indicative of evaluation of the image forming apparatus, for each condition, for non-uniformity in layer according to Comparative examples 1 to 4, and Examples 1 to 4 of the present invention. In Comparative examples 1 to 3, in the toner installation, the rotational speed of the first motor 86 was set as the rotational speed V3, and the rotational speed of the second motor 87 was set as the rotational speed V1. In Comparative example 4, in the toner installation, the rotational speed of the first motor 86 was set as the rotational speed V4 (four times the rotational speed V3), and the rotational speed of the second motor 87 was set as four times the rotational speed V1. In Examples 1 to 4, in the toner installation, the rotational speed of the first motor 86 was set as the rotational speed V4, and the rotational speed of the second motor 87 was set as the rotational speed V2 (half the rotational speed V1). The toner installation was performed with the use of the toner containers 39 having the developer stored in different states, respectively, according to Comparative examples 1 to 4 and Examples 1 to 4, and an installation time and presence or absence of non-uniformity in layer were then evaluated. In Comparative example 1 and Example 1, the toner container 39 having been stored, for 50 days after production, in an environment where the temperature was 5° C. and the humidity was 10%, was used. In Comparative example 2 and Example 2, the toner container 39 containing developer having been just produced, was used in an environment where the temperature was 23° C. and the humidity was 50%. In Comparative example 3 and Example 3, the toner container 39 containing developer having been just produced was used in an environment where the temperature was 5° C. and the humidity was 10%. In Comparative example 4 and Example 4, the toner container 39 having been stored, for 50 days after production, in an environment where the temperature was 23° C. and the humidity was 50%, was used. The presence or absence of variation in layer thickness (non-uniformity in layer) was visually confirmed in an output image in the image forming process after the toner installation. When a low image quality portion (dotted pattern, striped pattern, or the like) affected by variation in layer thickness was not confirmed, it is determined that there is no variation (Good: advantageous). When a low image quality portion affected by variation in layer thickness was confirmed, it is determined that there is a variation (Poor: disadvantageous).

In order to evaluate the variation in layer thickness, the multifunction peripheral "Taskalfa (registered trademark) 2200" manufactured by KYOCERA Document Solutions Inc. was used as the image forming apparatus 10 in the toner installation.

In each of Comparative examples 1 to 4 shown in FIG. 9, the evaluation is such that there is a variation in the developer layer held by the developing roller 64 in the toner installation. On the other hand, in each of Examples 1 to 4, the evaluation is such that there is no variation in developer layer, and an output image after image formation is advantageous. Therefore, as is understood from Examples 1 to 4, in the toner installation, the first motor 86 is driven to rotate at a speed higher than the rotational speed V3 for development, and when the second storage chamber 60C has been filled with the developer, the second motor 87 is driven to rotate at the rotational speed V2 that is half the rotational speed V1 for development, whereby the installation time can be shortened, and variation in layer thickness of the developer layer can be reduced, to prevent degradation of image quality.

Third Embodiment

Figure 10:
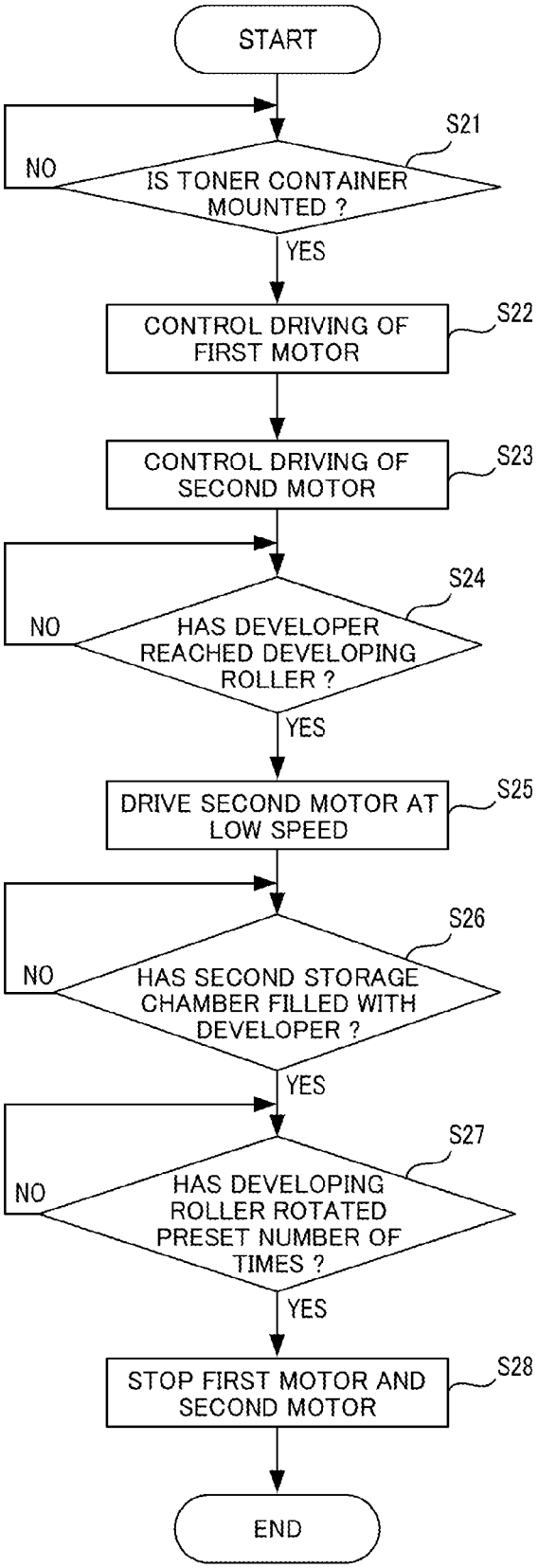
FIG. 10 is a flow chart showing an exemplary procedure of motor control, in the toner installation, which is executed by the control portion of the image forming apparatus.

Hereinafter, a third embodiment of the present invention will be described with reference to FIG. 10. The same components as described for the first embodiment are denoted by the reference numerals as used in the first embodiment, and the description of the components is not given. In the third embodiment and a fourth embodiment described below, the second motor 87 is an example of a driving portion of the present invention.

In the configuration of the image forming apparatus 10 of the first embodiment described above, when the developing roller 64 contacts with the developer and rotates, the developer is charged due to friction during the contact. Further, when the developer layer held by the developing roller 64 passes by the end portion of the regulation blade 65, the developer is further charged due to friction against each of the developing roller 64 and the regulation blade 65. In particular, during the toner installation, the charge amount generated when the developer layer passes by the regulation blade 65, may become excessive in some cases. However, in the present embodiment, the developing roller 64 is driven at a reduced speed during the toner installation, thereby preventing developer from being excessively charged.

In the image forming apparatus 10, when the developing roller 64 is rotated so as to cause the developing sleeve 67 to hold the developer, the developing roller 64 contacts with the developer, and the developer is charged with static electricity generated due to the contact friction. However, in a case where the developing roller 64 is rotated in order to shorten the installation time during the toner installation, when the developer conveyed in the axial direction of the developing roller 64 has reached the rear end portion 64B, a charge amount of the developer layer formed over the developing roller 64 along the axial direction thereof may vary in some cases. The variation in charge amount causes the thickness of the developer layer held by the developing roller 64 to become non-uniform. That is, the thickness of the developer layer held by the developing roller 64 varies. The variation in the layer thickness may cause generation of a dotted pattern, a striped pattern, or the like on an image on a paper sheet having the image formed thereon, to degrade image quality. Further, as described above, although the layer thickness of the developer layer is physically made uniform by the regulation blade 65, the developer is excessively charged due to friction by the contact with the regulation blade 65. In particular, in the toner installation, the developer regulated by the regulation blade 65 has not been accumulated on the regulation blade 65. Therefore, exchange of the developer between the accumulated developer and the developer layer held by the developing roller 64, is not performed. Therefore, a charge amount of the developer is likely to be increased. Thus, even when the thickness is made uniform by the regulation blade 65, a charge amount distribution in the developer layer is made non-uniform due to the developer layer being excessively charged, resulting in variation in thickness of the developer layer.

In order to overcome such a problem, in the present embodiment, the control portion 8 causes the CPU 81 to execute various calculation processes according to the motor control program, and control of driving of the first motor 86 and the second motor 87 with the use of the motor driver 85. Thus, during the toner installation, the control portion 8 controls the first motor 86 and the second motor 87 so as to be driven at a rotational speed (hereinafter, referred to as a normal rotational speed) for development operation. On the condition that the developer is determined as having reached the developing roller 64, the control portion 8 controls the first motor 86 and the second motor 87 so as to be driven at a rotational speed lower than the normal rotational speed.

Hereinafter, with reference to a flow chart of FIG. 10, an example of control of driving of the first motor 86 and the second motor 87 in the toner installation, and a procedure of the developer supply method of the present invention which is applied to the image forming apparatus 10, will be described. In FIG. 10, S21, S22, . . . represent the process procedure (step) numbers. In the following description, the toner container 39 for initial supply is mounted to the image forming apparatus 10 having the case body 60 that is vacant, and the toner installation is thereafter performed as an initial preparation operation in the image forming apparatus 10.

When the image forming apparatus 10 is powered on, the control portion 8 determines whether or not the toner container 39 is mounted to the image forming portion 3 (S21). The control portion 8 can determine whether or not the toner container 39 is mounted, based on, for example, an output signal from, for example, a sensor which outputs an ON signal when the toner container 39 is mounted. Alternatively, a user makes an input so as to notify the image forming apparatus 10 that the toner container 39 is mounted, and the control portion 8 can determine whether or not the toner container 39 is mounted, based on the inputted information. Alternatively, the control portion 8 can determine whether or not the toner container 39 is mounted, based on electrical connection with the connection portion 39B (see FIG. 4) being detected when the toner container 39 is mounted.

When the toner container 39 is determined, in step S21, as being mounted, the control portion 8 starts control of driving of the first motor 86 (S22). Specifically, the control portion 8 drives the first motor 86 to rotate at a rotational speed (normal rotational speed) for rotation during development by the developing device 34 in the image forming process. Thus, the supply screw 63, the conveying screw 62, the first agitating screw 61A, and the second agitating screw 61B are each rotated at a rotational speed for rotation during development. When the screws 63, 62, 61A, and 61B are thus rotated, the supplied developer is conveyed toward the developing roller 64.

In the subsequent step S23, the control portion 8 starts control of driving of the second motor 87. Control of driving of the second motor 87 is started at the same timing as control of driving of the first motor 86. That is, when the control portion 8 determines that the toner container 39 is mounted (Yes in S21), the control portion 8 starts control of driving of the second motor 87 (S23). Specifically, the control portion 8 drives the second motor 87 to rotate at the normal rotational speed. Thus, the developing roller 64 is rotated at a rotational speed V1 (an example of a fifth rotational speed of the present invention) for the rotation during development. That is, in step S23, the control portion 8 controls driving of the second motor 87 such that the developing roller 64 rotates at the predetermined rotational speed V1. Step S23 of thus controlling driving of the second motor 87 corresponds to an eleventh step in the developer supply method of the present invention.

In the subsequent step S24, the control portion 8 determines whether or not the developer has been conveyed to the developing roller 64. The control portion 8 that makes such a determination is an example of a first determination portion of the present invention. Further, step S24 of making such a determination corresponds to a twelfth step in the developer supply method of the present invention.

In the toner installation, when the developer is supplied, for the first time, into the case body 60 that is vacant, the developer having been supplied earliest is gradually conveyed in the first storage chamber 60B in the direction indicated by the arrow 96 by the first agitating screw 61A. The developer is transferred from the first storage chamber 60B through the communication path 113 into the second storage chamber 60C, and the developer reaches the front end portion 64A of the developing roller 64. Thereafter, the developer is gradually conveyed in the second storage chamber 60C in the direction indicated by the arrow 96 by the second agitating screw 61B, and the developer from the front end portion 64A reaches the rear end portion 64B on the other side. In the present embodiment, when the developer reaches the front end portion 64A, a level of an electric signal outputted by the density sensor 97 changes. In step S24, the control portion 8 determines that a density of the developer has changed, based on the change of the level of the electric signal, and determines that the developer has reached the front end portion 64A. That is, the control portion 8 determines that the developer has reaches the developing roller 64 side, based on the electric signal from the density sensor 97.

In the present embodiment, an exemplary case where the developer is determined as having reached the developing roller 64 side, based on the electric signal from the density sensor 97, is described. However, the present invention is not limited to this exemplary case. For example, the determination may be made in step S24 based on, for example, the number of times the second agitating screw 61B rotates, a conveying speed of the developer based on rotation of the second agitating screw 61B, or a measured value from a measurement portion for measuring a charge amount of the developing roller 64.

When the developer is determined, in step S24, as having reached the developing roller 64, the control portion 8 performs low speed driving control for the second motor 87 such that the developing roller 64 rotates at a rotational speed V2 (an example of a sixth rotational speed of the present invention) lower than the rotational speed V1 (S25). Step S25 of thus performing the low speed driving control for the second motor 87 corresponds to a thirteenth step in the developer supply method of the present invention.

In a state where developer does not adhere to the developing roller 64, contact friction on the surface of the developing roller 64 is increased. Therefore, friction generated due to contact between the developing roller 64 and the developer may cause the developer to be excessively charged in some cases. Therefore, in the image forming apparatus 10, the control portion 8 drives the second motor 87 to rotate at a low rotational speed that is lower than the normal rotational speed. Specifically, the second motor 87 is driven to rotate at half the normal rotational speed. Therefore, the developing roller 64 is rotated at the rotational speed V2 that is half the rotational speed V1 for rotation during development. When the developing roller 64 is thus rotated at the rotational speed V2 that is a half speed, the developer layer is prevented from being excessively charged during the toner installation. The rotational speed V2 is not limited to half the rotational speed V1, and may be a rotational speed lower than the rotational speed V1.

In the subsequent step S26, the control portion 8 determines whether or not the second storage chamber 60C has been filled with the developer. In the toner installation, the developer that has reached the front end portion 64A is gradually conveyed by the second agitating screw 61B to reach the rear end portion 64B on the other side. When the developer reaches the rear end portion 64B, the second storage chamber 60C is filled with the developer. In the present embodiment, when a preset time has elapsed since the developer that has reached the front end portion 64A has been detected by the density sensor 97, the control portion 8 determines that the second storage chamber 60C has been filled with the developer. The preset time is a time required for the developer to reach the rear end portion 64B since detection of the developer by the density sensor 97. The preset time may be a time based on, for example, an actually measured value. Alternatively, the preset time may be a time calculated according to a speed at which the developer is conveyed by the second agitating screw 61B, and a distance to the rear end portion 64B. That is, in step S26, the control portion 8 determines whether or not the developer having been supplied earliest in the toner installation has been conveyed to the rear end portion 64B.

When the second storage chamber 60C is determined, in step S26, as having been filled with the developer, the control portion 8 determines whether or not the developer is held over the entirety of the outer circumferential surface of the developing roller 64 (S27). The control portion 8 that makes such a determination corresponds to an example of a second determination portion of the present invention. Specifically, the control portion 8 determines whether or not the developing roller 64 has rotated a preset number of times. The preset number of times is the number of times based on which the evaluation that a layer of the developer has been formed over the entire region of the developing roller 64 with a uniform thickness, can be made. In the present embodiment, the preset number of times of the rotation is two. Needless to say, the preset number of times of the rotation can be set as any number, and is not limited to two as described above.

In the present embodiment, an exemplary case where it is determined, based on an electric signal from the density sensor 97 and the preset number of times, that the developer is held over the entirety of the outer circumferential surface of the developing roller 64, is described. However, the present invention is not limited to this exemplary case. For example, the determination may be made in step S27 based on, for example, the number of times the developing roller 64 has rotated at the rotational speed V2, or a measured value from a measurement portion for measuring a charge amount of the developing roller 64.

When the developing roller 64 is determined, in step S27, as having rotated the preset number of times, the control portion 8 determines that the toner installation has been completed, and stops driving of rotation of the first motor 86 and the second motor 87 (S28). That is, the control portion 8 rotates the developing roller 64 at the rotational speed V2 until the developer is determined, in step S27, as being held over the entirety of the outer circumferential surface of the developing roller 64.

As described above, in the image forming apparatus 10 of the present embodiment, when the toner installation is started, the first agitating screw 61A, the second agitating screw 61B, the developing roller 64, and the like are rotated at the rotational speed V1. When the developer is conveyed to reach the developing roller 64, the developing roller 64 is rotated at the rotational speed V2 lower than the rotational speed V1. Thus, the developer layer held by the developing roller 64 is prevented from being excessively charged, variation in layer thickness of the developer layer is reduced, and the thickness becomes uniform in the entire region in the axial direction. As a result, a dotted pattern, a striped pattern, and the like caused due to variation in layer thickness do not appear on an image on a paper sheet, thereby preventing degradation of image quality.

Further, the developing roller 64 is rotated at the rotational speed V2 until the developer is determined as being held over the entirety of the outer circumferential surface of the developing roller 64. Therefore, the developer is continuously prevented from being excessively charged until a layer of the developer having a uniform thickness is formed over the entire region of the developing roller 64.

As shown in FIG. 12A, for the third embodiment, comparison between variation (non-uniformity in layer) in layer thickness of the developer layer in the case of the low speed driving control (S25) for the second motor 87 being not performed and variation in layer thickness in the case of the low speed driving control being performed, is performed for evaluation. FIG. 12A shows a table indicative of evaluation of the image forming apparatus 10, for each of different gaps of the regulation blade 65, for variation in layer thickness according to Comparative example 5 and Example 5. Comparative example 5 represents an exemplary case where the low speed driving control was not performed, and Example 5 represents an exemplary case where the low speed driving control was performed. In FIG. 12A, in each of Comparative example 5 and Example 5, a gap of the regulation blade 65 was varied in increments of 0.05 mm in a range from 0.25 mm to 0.50 mm, to evaluate variation in layer thickness. The presence or absence of variation in layer thickness was visually confirmed in an output image in the image forming process after the toner installation. When a low image quality portion (dotted pattern, striped pattern, or the like) affected by variation in layer thickness was not confirmed, Good (Good: advantageous) indicating that there is no variation is indicated. When a low image quality portion affected by variation in layer thickness was confirmed, Poor (Poor: disadvantageous) indicating that there is a variation is indicated.

In order to evaluate the variation in layer thickness, the multifunction peripheral "Taskalfa (registered trademark) 2200" manufactured by KYOCERA Document Solutions Inc. was used as the image forming apparatus 10 in the toner installation.

As shown in FIG. 12A, in Comparative example 5 in which the low speed driving control for the second motor 87 was not performed, the evaluation is such that there is a variation in layer thickness regardless of the gap of the regulation blade 65. On the other hand, in Example 5 in which the low speed driving control was performed, the evaluation is such that, when the gap is from 0.25 mm to 0.35 mm, there is no variation in the layer thickness and an output image after the image formation is advantageous. However, the evaluation is such that there is a variation in layer thickness when the gap is from 0.25 mm to 0.35 mm. Therefore, in Example 5, in a case where the gap is from 0.25 mm to 0.35 mm, when the low speed driving control of step S25 is performed in the toner installation, variation in the layer thickness of the developer layer can be reduced, and degradation of image quality can be prevented.

Fourth Embodiment

Figure 11:
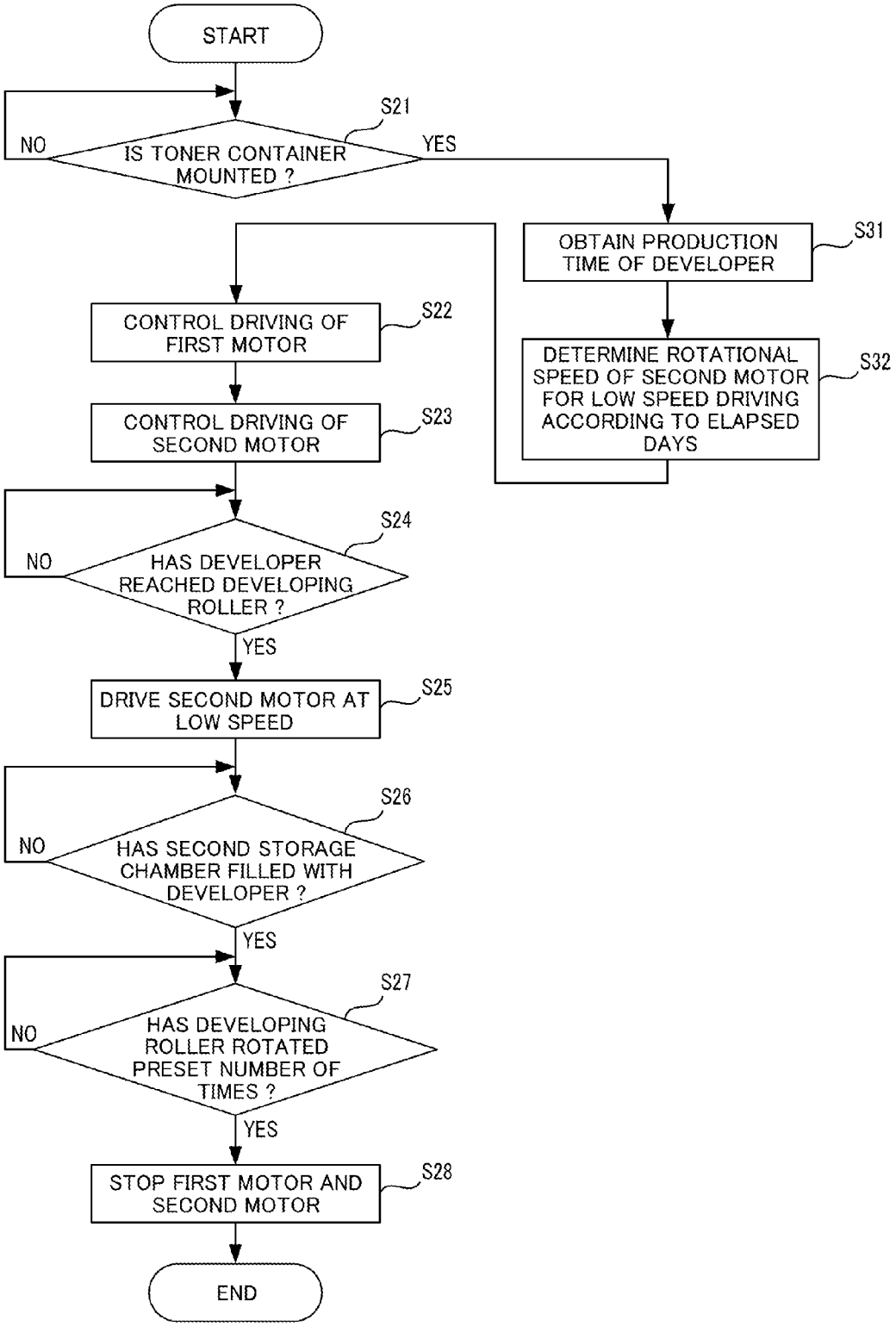
FIG. 11 is a flow chart showing another exemplary procedure of motor control, in the toner installation, which is executed by the control portion of the image forming apparatus.

Subsequently, with reference to FIG. 11 and FIG. 12B, a fourth embodiment of the present invention will be described. The same components as described for the third embodiment are denoted by the reference numerals as used in the third embodiment, and the description of the components is not given. The fourth embodiment is different from the third embodiment in that the motor control by the control portion 8 includes new process steps of step S31 and step S32 in FIG. 11 in the fourth embodiment.

Another example of control of driving of the first motor 86 and the second motor 87 during the toner installation will be described below with reference to a flow chart of FIG. 11. Also in the below description, the toner container 39 for initial supply is mounted to the image forming apparatus 10 having the case body 60 that is vacant, and the toner installation is thereafter performed as an initial preparation operation in the image forming apparatus 10.

When the toner container 39 is determined, in step S21, as being mounted (Yes in S21), the control portion 8 obtains information representing a production time of the developer to be supplied from the toner container 39 (S31). The control portion 8 that obtains the information representing the production time is an example of the obtaining portion of the present invention. For example, the control portion 8 allows a user to input, to the image forming apparatus 10, a production time of the developer stored in the toner container 39, whereby the control portion 8 can determine the production time based on the inputted information. Alternatively, the control portion 8 reads, from the memory of the connection portion 39B, the production time stored in the memory, by electrical connection with the connection portion 39B (see FIG. 4) when the toner container 39 is mounted, thereby determining the production time.

In the subsequent step S32, the control portion 8 obtains an elapsed time after production based on the production time having been obtained in step S31, and determines, according to the elapsed time, a rotational speed of the second motor 87 for which the low speed driving control is performed in step S25. Specifically, a speed reduction rate is determined based on the elapsed time, and a rotational speed (hereinafter, referred to as a reduced rotational speed) is calculated by the normal rotational speed being multiplied by the speed reduction rate. The reduced rotational speed having been calculated is set in, for example, the register of the CPU 81 or the EEPROM 84 of the control portion 8. The reduced rotational speed determined in step S32 is less than the normal rotational speed.

A relationship between days that have elapsed after production of developer and a charge amount of the developer will be described. In general, in the final production process step for developer, the developer is sufficiently agitated by an agitator. Therefore, immediately after the developer has been produced, the developer is highly charged with static electricity due to friction during agitation. That is, the developer is excessively charged immediately after the production of the developer. On the other hand, in a case where the number of days that have elapsed after the production is increased, a charge amount of the developer is gradually reduced, and eventually stabilized at a constant charge amount. Specifically, developer having a charge amount of 8.0 μc/g immediately after the production was stored in the toner container 39 and left for 500 days as it was in an environment where the temperature was 23° C. and the humidity was 50%, and the charge amount of the stored developer was observed during the days. As a result, as shown in FIG. 7, as the number of days that have elapsed is increased, the charge amount is gradually reduced, and stabilized at almost 5.0 μc/g when about six months (180 days) have elapsed. Thus, the charge amount of the developer layer held by the developing roller 64 is different between: the toner installation using the toner container 39 that contains developer having been just produced; and the toner installation using the toner container 39 that contains developer having been produced certain days before. Further, even if the developing roller 64 is rotated at the rotational speed V2 in the toner installation to reduce the charge amount, difference in days that have elapsed after production of the toner container 39 causes difference in a charge amount of the developer layer in each toner installation. In particular, in a case where the toner container 39 that contains developer having been just produced is used in the toner installation, even if the developing roller 64 is rotated at the rotational speed V2, a charge amount of the developer layer on the developing roller 64 becomes excessive, whereby image quality may be degraded.

Therefore, in step S32, the control portion 8 determines the reduced rotational speed for step S25 in the toner installation such that the less the number of days that have elapsed after production of the developer is, the lower the reduced rotational speed is. Thus, the less the number of days that have elapsed is, the lower the rotational speed V2 of the developing roller 64 is. Further, the control portion 8 determines the reduced rotational speed such that the greater the number of days that have elapsed is, the higher the reduced rotational speed is. Thus, the greater the number of days that have elapsed is, the higher the rotational speed V2 of the developing roller 64 is. Specifically, a lookup table representing a relationship between the number of days that have elapsed, and the corresponding speed reduction rate, is stored in the EEPROM 84 of the control portion 8. The control portion 8 obtains the number of days that have elapsed after production of the toner container 39 to be used in the toner installation, and reads, from the lookup table, the speed reduction rate corresponding to the number of days that have elapsed. The control portion 8 determines the reduced rotational speed by multiplying the normal rotational speed by the speed reduction rate having been read. After the charge amount of the developer in the toner container 39 has been stabilized during the storage, the control portion 8 sets the rotational speed corresponding to the stabilized charge amount, as the rotational speed of the second motor 87, regardless of the number of days that have elapsed.

When the reduced rotational speed of the second motor 87 in step S25 is determined in step S32, the first motor 86 and the second motor 87 are driven to rotate at the rotational speed V1 (S22, S23), and, in a case where the developer has thereafter reached the developing roller 64 (S24), the low speed driving control is performed so as to drive the second motor 87 at the reduced rotational speed determined in step S32 (S25). Thereafter, process steps up to step S28 are performed according to the procedure described above.

As described above, in the fourth embodiment, the rotational speed of the second motor 87 under the low speed driving control in the toner installation is determined according to the number of days that have elapsed after the production of the developer, and the low speed driving control for the second motor 87 at the determined rotational speed, is performed. Therefore, the charge amount of the developer layer becomes constant, and the layer thickness of the developer layer on the developing roller 64 after the toner installation constantly becomes uniform, regardless of a production time of the developer.

As described above, in the fourth embodiment, the reduced rotational speed of the second motor 87 under the low speed driving control in the toner installation is determined according to the number of days that have elapsed after the production of the developer, and the second motor 87 is driven to rotate at the reduced rotational speed in step S25. Therefore, the charge amount of the developer layer becomes constant, and the layer thickness of the developer layer on the developing roller 64 after the toner installation constantly becomes uniform, regardless of a production time of the developer.

As shown in FIG. 12B, for the fourth embodiment, comparison between variation (non-uniformity in layer) in layer thickness of the developer layer in the case of the low speed driving control (S25) for the second motor 87 being not performed and variation in layer thickness in the case of the low speed driving control being performed, is performed for evaluation. FIG. 12B shows a table indicative of evaluation of the image forming apparatus 10, for each of different gaps of the regulation blade 65, for variation in layer thickness according to Examples 6 to 8. Example 6 represents an exemplary case where the low speed driving control for the second motor 87 at a reduced rotational speed that was obtained by the normal rotational speed being multiplied by the speed reduction rate of 50% was performed with the use of the toner container 39 having been just produced. Example 7 represents an exemplary case where the low speed driving control for the second motor 87 at a reduced rotational speed that was obtained by the normal rotational speed being multiplied by the speed reduction rate of 50% was performed with the use of the toner container 39 having been produced three months before. Example 8 represents an exemplary case where the low speed driving control for the second motor 87 at a reduced rotational speed that was obtained by the normal rotational speed being multiplied by the speed reduction rate of 40% was performed with the use of the toner container 39 having been produced three months before. In FIG. 12B, in each of Examples 6 to 8, a gap of the regulation blade 65 was varied in increments of 0.05 mm in a range from 0.25 mm to 0.50 mm, to evaluate variation in layer thickness. The presence or absence of variation in layer thickness was visually confirmed in an output image in the image forming process after the toner installation, as in the third embodiment described above. When a low image quality portion (dotted pattern, striped pattern, or the like) affected by variation in layer thickness was not confirmed, Good (Good: advantageous) indicating that there is no variation is indicated. When a low image quality portion affected by variation in layer thickness was confirmed, Poor (Poor: disadvantageous) indicating that there is a variation is indicated.

In order to evaluate the variation in layer thickness, the multifunction peripheral "Taskalfa (registered trademark) 2200" manufactured by KYOCERA Document Solutions Inc. was used as the image forming apparatus 10 in the toner installation.

As shown in FIG. 12B, in Example 6, the evaluation is such that, when the gap is from 0.25 mm to 0.35 mm, there is no variation in layer thickness, and an output image after the image formation is advantageous. However, the evaluation is such that there is a variation in layer thickness when the gap is from 0.25 mm to 0.35 mm. In both of Examples 7 and 8, the evaluation is such that, when the gap is from 0.25 mm to 0.45 mm, there is no variation in layer thickness, and an output image after the image formation is advantageous. However, the evaluation is such that there is a variation in layer thickness when the gap is 0.50 mm. Thus, it can be understood that, even when the same speed reduction rate of 50% is used, the layer thickness is less likely to vary in the toner container 39 having been produced three months before, as compared to the toner container 39 having been just produced. Further, the evaluation is the same between a case where the speed reduction rate is 50% and the toner container 39 having been produced three months before is used, and a case where the speed reduction rate is 40% and the toner container 39 having been produced three months before is used. That is, in a case where the toner container 39 having been produced three months before, is used, even when the speed reduction rate is reduced from 50% to 40% to increase the rotational speed of the second motor 87, the evaluation is the same. Therefore, the greater the number of days that have elapsed after the production of the toner container 39 is, the less the speed reduction rate for the rotational speed of the second motor 87 is, whereby the time for the toner installation can be shortened.

The invention claimed is:

1. An image forming apparatus comprising:

a developing device having a storage chamber in which developer is stored;

a supply portion, provided in the developing device, configured to guide, into the storage chamber, the developer supplied from outside;

a developing roller, provided in the storage chamber so as to be rotatable, configured to contact with the developer stored in the storage chamber to hold the developer on an outer circumferential surface by the developing roller being driven to rotate;

a conveying member, provided in the storage chamber so as to be rotatable, configured to convey the developer supplied from the supply portion, from one end, in an axial direction, of the developing roller to the other end by the conveying member being driven to rotate;

a first driving portion configured to drive the developing roller so as to rotate;

a second driving portion configured to drive the conveying member so as to rotate;

a driving control portion configured to control driving of the first driving portion in a state where the second driving portion is stopped until the developer is conveyed to the other end by the conveying member, in a case where the developer is supplied from the supply portion into the storage chamber that is vacant, and to start control of driving of the second driving portion on the condition that the developer has been conveyed to the other end; and an obtaining portion configured to obtain information representing a production time of the developer to be supplied from the supply portion, wherein the driving control portion determines a second rotational speed that is lower than a first rotational speed at which the developing roller is driven to rotate during development by the developing device, according to an elapsed time, after production, which is calculated based on the production time, and starts control of driving of the second driving portion such that the developing roller rotates at the second rotational speed having been determined.

2. The image forming apparatus according to claim 1, wherein the driving control portion controls driving of the second driving portion such that the developing roller rotates at the second rotational speed until the developing roller rotates a preset number of times that is higher than a third rotational speed at which the conveying member is driven to rotate during development by the developing device, until the developer is conveyed to the other end.

3. The image forming apparatus according to claim 1, wherein the driving control portion controls driving of the first driving portion such that the conveying member rotates at a fourth rotational speed that is higher than a third rotational speed at which the conveying member is driven to rotate during development by the developing device, until the developer is conveyed to the other end.

4. The image forming apparatus according to claim 1, wherein the driving control portion determines the second rotational speed such that the shorter the elapsed time is, the lower the second rotational speed with respect to the first rotational speed is, and the longer the elapsed time is, the higher the second rotational speed with respect to the first rotational speed is.

5. An image forming apparatus comprising:

a developing device having a storage chamber in which developer is stored;

a supply portion, provided in the developing device, configured to guide, into the storage chamber, the developer supplied from outside;

a developing roller, provided in the storage chamber so as to be rotatable, configured to contact with the developer stored in the storage chamber to hold the developer on an outer circumferential surface by the developing roller being driven to rotate;

a conveying member, provided in the storage chamber so as to be rotatable, configured to convey the developer supplied from the supply portion, toward the developing roller, by the conveying member being driven to rotate;

a first determination portion configured to determine that the developer conveyed by the conveying member has reached the developing roller;

a driving portion configured to drive at least the developing roller so as to rotate; and a driving control portion configured to control driving of the driving portion such that the developing roller rotates at a predetermined fifth rotational speed in a case where the developer is supplied from the supply portion into the storage chamber that is vacant, and to control driving of the driving portion such that the developing roller rotates at a sixth rotational speed lower than the fifth rotational speed on the condition that the first determination portion determines that the developer has reached the developing roller.

6. The image forming apparatus according to claim 5, further comprising a second determination portion configured to determine that the developer conveyed by the conveying member is held over an entirety of the outer circumferential surface of the developing roller, wherein the driving control portion controls driving of the driving portion such that the developing roller rotates at the sixth rotational speed until the second determination portion determines that the developer is held over the entirety of the outer circumferential surface of the developing roller.

7. The image forming apparatus according to claim 6, wherein the second determination portion makes determination based on one of a number of times the developing roller rotates at the sixth rotational speed, a measured value from a measurement portion that measures a charge amount of the developing roller, and a sensor signal from a density sensor that detects a density of the developer in the storage chamber.

8. The image forming apparatus according to claim 5, further comprising an obtaining portion configured to obtain information representing a production time of the developer to be supplied from the supply portion, wherein the driving control portion determines the sixth rotational speed according to an elapsed time, after production, which is calculated based on the production time, and controls driving of the driving portion such that the developing roller rotates at the sixth rotational speed having been determined.

9. The image forming apparatus according to claim 8, wherein the driving control portion determines the sixth rotational speed such that the shorter the elapsed time is, the lower the sixth rotational speed with respect to the fifth rotational speed is, and the longer the elapsed time is, the higher the sixth rotational speed with respect to the fifth rotational speed is.

10. The image forming apparatus according to claim 5, wherein the fifth rotational speed is a speed at which the developing roller is driven to rotate during development by the developing device.

11. The image forming apparatus according to claim 5, wherein the first determination portion makes determination based on one of a number of times the conveying member rotates, a measured value from a measurement portion that measures a charge amount of the developing roller, and a sensor signal from a density sensor that detects a density of the developer in the storage chamber.

12. A developer supply method for supplying developer into a storage chamber in a state where the storage chamber is vacant without storing the developer, the developer supply method being performed by an image forming apparatus that includes: a developing device having the storage chamber in which the developer is stored; a supply portion, provided in the developing device, configured to guide, into the storage chamber, the developer supplied from outside; a developing roller, provided in the storage chamber so as to be rotatable, configured to contact with the developer stored in the storage chamber to hold the developer on an outer circumferential surface by the developing roller being driven to rotate; a conveying member, provided in the storage chamber so as to be rotatable, configured to convey the developer supplied from the supply portion, from one end, in an axial direction, of the developing roller to the other end by the conveying member being driven to rotate; and an obtaining portion configured to obtain information representing a production time of the developer to be supplied from the supply portion, the developer supply method comprising;

a first step of driving the conveying member so as to rotate, and causing the conveying member to convey the developer to the other end in a state where rotation of the developing roller is stopped; and a second step of starting driving of rotation of the developing roller on the condition that the developer has been conveyed to the other end, wherein in the second step, a second rotational speed that is lower than a first rotational speed at which the developing roller is driven to rotate during development by the developing device, is determined according to an elapsed time, after production, which is calculated based on the production time, and control of driving of the second driving portion is started to rotate the developing roller at the second rotational speed having been determined.

13. A developer supply method for supplying developer into a storage chamber in a state where the storage chamber is vacant without storing the developer, the developer supply method being performed by an image forming apparatus that includes: a developing device having the storage chamber in which the developer is stored; a supply portion, provided in the developing device, configured to guide, into the storage chamber, the developer supplied from outside; a developing roller, provided in the storage chamber so as to be rotatable, configured to contact with the developer stored in the storage chamber to hold the developer on an outer circumferential surface by the developing roller being driven to rotate; a conveying member, provided in the storage chamber so as to be rotatable, configured to convey the developer supplied from the supply portion, toward the developing roller, by the conveying member being driven to rotate; and a driving portion configured to drive at least the developing roller so as to rotate, the developer supply method comprising;

an eleventh step of controlling driving of the driving portion such that the developing roller rotates at a predetermined fifth rotational speed when the developer is supplied from the supply portion;

a twelfth step of determining that the developer conveyed by the conveying member has reached the developing roller; and a thirteenth step of controlling driving of the driving portion such that the developing roller rotates at a sixth rotational speed lower than the fifth rotational speed on the condition that the developer is determined in the twelfth step as having reached the developing roller.

* * * * *